US012473785B2

(12) United States Patent
Parkin et al.

(10) Patent No.: US 12,473,785 B2
(45) Date of Patent: Nov. 18, 2025

(54) METHODS FOR DOWNHOLE DRILLING AND COMMUNICATION

(71) Applicant: Schlumberger Technology Corporation, Sugar Land, TX (US)

(72) Inventors: Edward George Parkin, Stonehouse (GB); Christopher Rowe, Stonehouse (GB); Cecily Millwater, Farnborough (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/782,109

(22) Filed: Jul. 24, 2024

(65) Prior Publication Data

US 2024/0376792 A1 Nov. 14, 2024

Related U.S. Application Data

(63) Continuation of application No. 18/048,210, filed on Oct. 20, 2022, now Pat. No. 12,049,793.

(60) Provisional application No. 63/262,815, filed on Oct. 21, 2021.

(51) Int. Cl.

| | |
|---|---|
| ***E21B 21/08*** | (2006.01) |
| ***E21B 7/06*** | (2006.01) |
| ***E21B 47/022*** | (2012.01) |
| ***E21B 47/24*** | (2012.01) |

(52) U.S. Cl.

CPC ..... *E21B 21/08* (2013.01); *E21B 7/06* (2013.01); *E21B 47/022* (2013.01); *E21B 47/24* (2020.05)

(58) Field of Classification Search

CPC ..... E21B 47/12; E21B 47/18

See application file for complete search history.

(56) References Cited

U.S. PATENT DOCUMENTS

| | | | | |
|---|---|---|---|---|
| 6,089,332 | A * | 7/2000 | Barr | E21B 21/10 175/45 |
| 8,708,064 | B2 | 4/2014 | Downton | |
| 9,035,788 | B2 * | 5/2015 | Downton | E21B 47/20 340/853.3 |
| 10,001,004 | B2 | 6/2018 | Bayliss et al. | |
| 10,184,296 | B2 | 1/2019 | Niina et al. | |
| 10,995,604 | B2 | 5/2021 | Hornblower | |
| 11,634,982 | B2 * | 4/2023 | Zhang | E21B 47/095 166/250.08 |
| 11,788,357 | B2 * | 10/2023 | Nanayakkara | E21B 7/06 175/61 |
| 12,247,485 | B2 * | 3/2025 | Zhang | E21B 7/062 |

(Continued)

FOREIGN PATENT DOCUMENTS

WO 2019164647 A1 8/2019

*Primary Examiner* — Tara Schimpf
*Assistant Examiner* — Ursula Lee Norris
(74) *Attorney, Agent, or Firm* — Jeffrey D. Frantz

(57) ABSTRACT

A pressure pulse generator and an RSS may change the pressure of a fluid flow through a BHA. If the dogleg at the BHA is less than a target dogleg, then the pressure pulse generator goes into pass-through mode to increase the pressure at the RSS and thereby increase a pad force of the RSS steering pads, increasing the severity of the dogleg. If a downhole tool is stuck, then the pressure pulse generator and the RSS are simultaneously actuated to unstick the downhole tool. The RSS is used to generate and transmit pressure pulses to a downhole tool.

20 Claims, 12 Drawing Sheets

(56) References Cited

U.S. PATENT DOCUMENTS

| | | | | |
|---|---|---|---|---|
| 2003/0024738 | A1 | 2/2003 | Schuh | |
| 2005/0269082 | A1 | 12/2005 | Baron et al. | |
| 2016/0160567 | A1* | 6/2016 | Downton | E21B 44/005 175/73 |
| 2020/0392790 | A1 | 12/2020 | Perry | |
| 2021/0324682 | A1 | 10/2021 | Chambers | |
| 2023/0125784 | A1 | 4/2023 | Parkin | |
| 2023/0130310 | A1* | 4/2023 | Ignova | E21B 7/06 175/45 |
| 2024/0003199 | A1* | 1/2024 | Menger | E21B 47/18 |

* cited by examiner

METHODS FOR DOWNHOLE DRILLING AND COMMUNICATION

CROSS-REFERENCE TO RELATED APPLICATIONS

This application is a continuation of U.S. patent application Ser. No. 18/048,210, filed Oct. 20, 2022, which claims the benefit of, and priority to, U.S. Patent Application No. 63/262,815, filed Oct. 21, 2021. Each of the foregoing is expressly incorporated herein by this reference in its entirety.

BACKGROUND

Downhole drilling systems may include downhole tools. Downhole tools may operate using drilling fluid pressure. Some downhole tools may change the drilling fluid pressure. A pressure pulse generator may generate periodic changes in the drilling fluid pressure to transmit a signal encoded in the pattern of pressure pulses. A rotary steerable system may use drilling fluid pressure to extend steering pads to a wellbore wall, which may change the directory of a bit.

SUMMARY

In some embodiments, a method for downhole communication includes flowing a fluid flow through a rotary steerable system; actuating at least one steering pad of a plurality of steering pads of the rotary steerable system, wherein actuating the at least one steering pad includes actuating the at least one steering pad in a pattern, the pattern including encoded data; changing at least one of the fluid flow or a drilling fluid pressure in response to actuating the at least one steering pad; and receiving the pattern at a downhole tool based on the changes in the at least one of the fluid flow or the drilling fluid pressure.

In some embodiments, a method for downhole communication includes flowing a fluid flow through a rotary steerable system, the rotary steerable system including a plurality of digital valves that actuate a plurality of steering pads; changing a fluid pressure of the fluid flow by: actuating at least one digital valve of the plurality of digital valves in a pattern, the pattern including encoded data; extending and retracting a steering pad of the plurality of steering pads associated with the at least one digital valve; receiving the change in fluid pressure at a downhole tool; and decoding the encoded data in the pattern at the downhole tool.

In some embodiments, a method for downhole communication includes operating a rotary steerable system, including: flowing a fluid flow through the rotary steerable system; opening a digital valve of a plurality of digital valves to direct a portion of the fluid flow to an associated steering pad of a plurality of steering pads; extending the associated steering pad of the plurality of steering pads to contact a wellbore wall; generating a set of pressure pulses by selectively opening the plurality of digital valves to change a fluid pressure of the rotary steerable system, the set of pressure pulses including encoded data; receiving the set of pressure pulses at a downhole tool; and decoding the encoded message at the downhole tool.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

This application generally relates to methods and systems for downhole pressure modulation using an RSS and a pressure pulse generator. Downhole pressure modulation may be used for many different downhole drilling activities. In some embodiments, a pressure pulse generator may be placed into a non-actuating mode (e.g., turned off) to increase the pressure at the RSS. In this manner, if the dogleg of the RSS is less than a target dogleg of the RSS, then the dogleg severity may be increased by increasing the pressure at the RSS. This may increase the dogleg severity to the target dogleg. In some embodiments, simultaneously actuating the pressure pulse generator and the RSS may spike the drilling fluid pressure enough to unblock or unstick a downhole tool. Furthermore, by modulating the downhole pressure at the RSS, the RSS may generate pressure pulses to communicate with downhole tools. By modulating the pressure at the pressure pulse generator and the RSS, operation of the BHA and the downhole drilling system may be improved.

Figure 1:
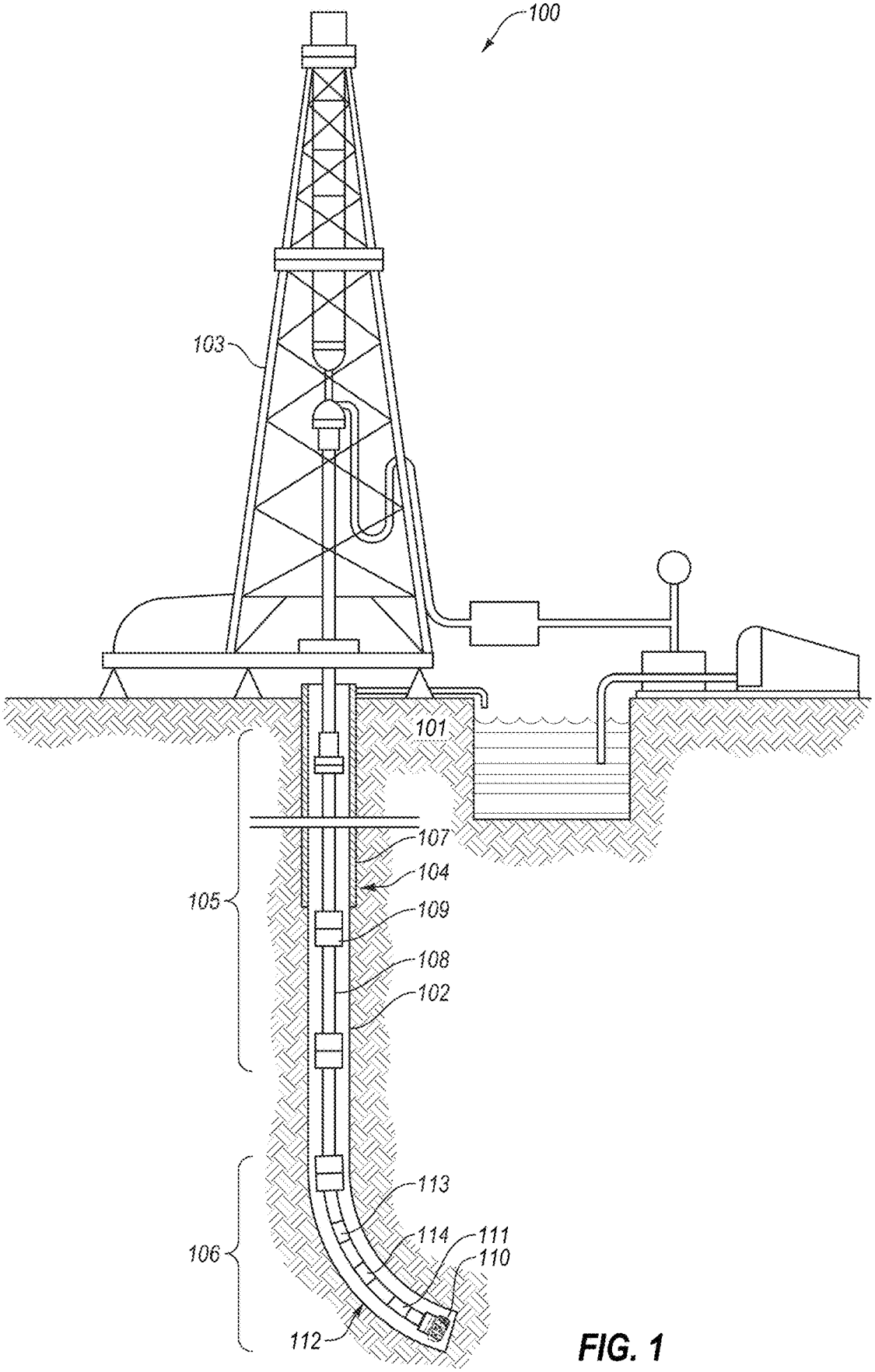
FIG. 1 is a representation of a downhole drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS) 111. The RSS 111 may include directional drilling tools that change a direction of the bit 110, and thereby the trajectory of the wellbore. At least a portion of the RSS 111 may maintain a geostationary position relative to an absolute reference frame, such as gravity, magnetic north, and/or true north. Using measurements obtained with the geostationary position, the RSS 111 may locate the bit 110, change the course of the bit 110, and direct the directional drilling tools on a projected trajectory. A change in course of the bit 110 caused by the RSS 111 may be a dogleg 112. The dogleg 112 may be determined by degrees of deviation per 100 feet, radius of curvature, arc length, and combinations thereof.

The BHA 106 may include one or more communication features. For example, the BHA 106 may include a pressure pulse generator 113. The pressure pulse generator 113 may create changes in the flow rate and/or the pressure of the fluid flow. For the purposes of this disclosure, pressure pulses may include any measurable change in hydraulic properties of the fluid flow, including volumetric flow rate and hydraulic pressure. These pressure pulses may be generated in a pattern, the pattern including encoded data. By sensing the pressure pulses and decoding the pattern, the encoded data may be received. Some downhole tools on the BHA 106 may be able to receive and decode the pressure pulse signal. For example, an MWD tool may include a fluid pressure sensor that may detect the changes in fluid pressure caused by the pressure pulse generator. Thus, the MWD may receive and decode the pressure pulse signal. In some examples, a turbine, such as for power generation or on the RSS 111, may detect the changes in volumetric flow rate caused by the pressure pulse generator. Thus, a turbine may receive and decode the signal encoded in the pressure pulses.

The BHA 106 may further include one or more downhole tools 114. The downhole tool 114 may be drilling fluid-actuated (e.g., mud-actuated). In this manner, the downhole tool 114 may have one or more moving parts that move based on a change in fluid properties, including volumetric flow rate, density, pressure, and other fluid properties. Examples of drilling fluid-actuated downhole tools 114 include expandable reamers, expandable casing cutters, expandable section mills, expandable stabilizers, mud motors, hydraulic valves, electromechanical valves, spring-actuated valves, other downhole tools, and combinations thereof.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
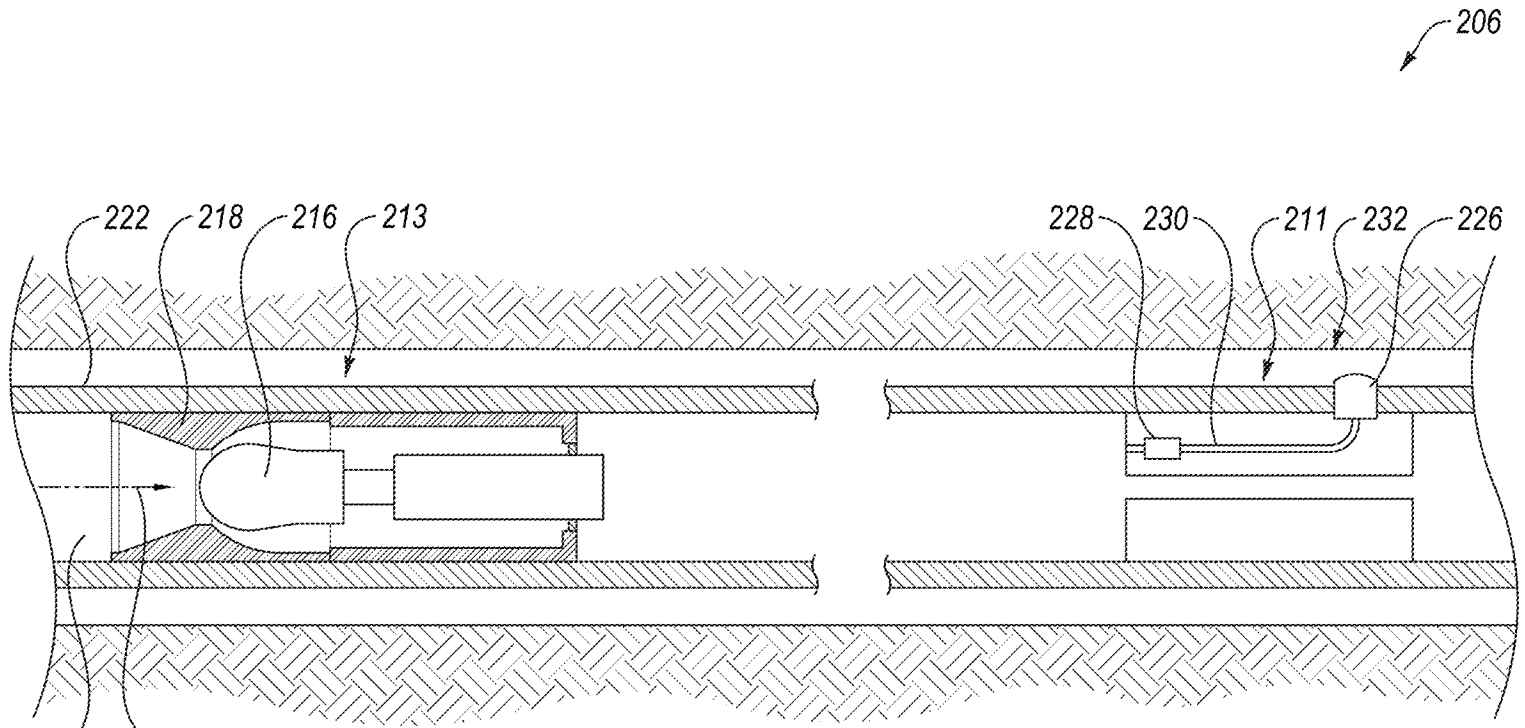
FIG. 2 is a representation of a bottomhole assembly, according to at least one embodiment of the present disclosure.

FIG. 2 is a representation of a portion of a BHA 206, according to at least one embodiment of the present disclosure. The BHA 206 shown includes a pressure pulse generator 213. The pressure pulse generator 213 may include a flow restrictor 216. The flow restrictor 216 may be longitudinally movable relative to a restriction 218 in the bore 220 of a housing 222. As the flow restrictor 216 moves closer to the restriction 218, a fluid flow 224 through the bore 220 may be impeded. As the flow restrictor 216 moves further away from the restriction 218, the fluid flow 224 may be unimpeded. When the flow restrictor 216 is located away from the restriction 218, the pressure pulse generator 213 may be in a non-actuating mode. For example, the pressure pulse generator 213 may be placed in a pass-through mode. The pass-through mode may be the mode at which the pressure pulse generator 213 does not increase the drilling fluid pressure of the fluid flow 224. In other words, the fluid flow 224 is unimpeded in the pass-through mode. Impeding and unimposing the fluid flow 224 may cause changes in the volumetric flow rate and/or drilling fluid pressure of the fluid flow 224. Placing the pressure pulse generator 213 in pass-through mode may also be considered turning the pressure pulse generator 213 off. By longitudinally moving the flow restrictor 216 in a pattern, a pattern of pressure pulses (and/or flow rate pulses) may be generated. In some examples, the pressure pulse generator 213 may be placed in a closed mode, where the fluid flow 224 is impeded through the pressure pulse generator 213. This may increase the drilling fluid pressure of the fluid flow 224.

The pattern of pressure pulses generated by the pressure pulse generator 213 may include encoded information. In this manner, the BHA 206 may communicate with other portions of a downhole drilling assembly, including an MWD, an LWD, other downhole tools, an RSS 211, the surface, and combinations thereof. In some embodiments, information may be transmitted to the pressure pulse generator 213 from other downhole tools, such as sensors, an MWD, an LWD, the RSS 211, or other downhole tools. For example, information may be transmitted to the pressure pulse generator via a wired connection, a wireless connection (e.g., electromagnetic signals), or other connection. This information may be converted into a pressure pulse pattern, and the pressure pulse generator 213 may generate pressure pulses in the pressure pulse pattern.

The BHA 206 shown includes an RSS 211. The RSS 211 includes a plurality of steering pads 226. A digital valve 228 may be connected to the steering pad 226 with a hydraulic pathway 230. The digital valve 228 may be electronically controlled. In a first position, the digital valve 228 may open the hydraulic pathway 230 to the steering pad 226. This may cause a portion of the fluid flow 224 to be diverted into the hydraulic pathway 230 and to push on the steering pad 226. This may extend the steering pad 226 radially outward from the RSS 211. The steering pad 226 may contact a wellbore wall 232 with a pad force. This may push on the RSS 211, which may push the bit (e.g., bit 110 of FIG. 1) in the direction opposite the pad force. By timing the actuation of the digital valves 228 to open when the steering pad 226 is at a specified rotational position, the bit may push on a trajectory, which may cause a dogleg in the wellbore. In some embodiments, actuating the digital valve 228 (and the steering pad 226) may change the pressure of the fluid flow 224. While the steering pads 226 shown are used in the RSS 211, it should be understood that the principles of the present disclosure may be applicable to any piston, pad, expandable tool, or other member actuated or operated by a digital valve 228.

In some embodiments, a digital valve 228 may be any valve configured to open the hydraulic pathway. For example, the digital valve 228 may be a solenoid valve, a rotary valve, a shuttle valve, a ball valve, any other valve, and combinations thereof. In some embodiments, the digital valve 228 may be electronically actuated. In this manner, the digital valve 228 may actuate regardless of the rotational orientation of the RSS 211. Actuation of the digital valve 228 may be controlled by a processor on the RSS 211, by an MWD, an LWD, by any other processor, and combinations thereof.

The fluid flow 224 may flow with a drilling fluid pressure 224. The drilling fluid pressure may be related to the pad force. A higher drilling fluid pressure may result in a higher pad force, and a lower drilling fluid pressure may result in a lower pad force. In some embodiments, a downhole drilling system (including the BHA 206) may be designed to operate at a design drilling fluid pressure. The design drilling fluid pressure may incorporate the pressure requirements of each downhole tool, including the RSS 211 and the pressure pulse generator 213. Thus, when operating at the design drilling fluid pressure, the RSS 211 may operate with a design pad force. The design pad force may be the force determined to be sufficient to steer with a target dogleg (e.g., the dogleg 112 of FIG. 1). In some embodiments, a downhole drilling system may not operate at higher than the design drilling fluid pressure. The surface pumps, which pump the drilling fluid downhole, may be sized to operate at the design drilling fluid pressure. However, in some embodiments, the surface pumps may not safely operate at higher pressure than the design drilling fluid pressure.

In some embodiments, an operating dogleg may be an actual measured dogleg of the downhole drilling system. In some embodiments, the operating dogleg may be different from the target dogleg. For example, the operating dogleg may be less than the target dogleg. In other words, the wellbore may not be turning as sharply as desired or intended. In some embodiments, increasing the pad force with which the steering pad 226 pushes against the wellbore wall 232 may increase the operating dogleg. However, because the surface pumps may not safely operate at a higher pressure than the design fluid pressure, then the pad force at the design drilling fluid pressure may not be increased.

In some embodiments, the operating drilling fluid pressure may be increased by moving the flow restrictor 216 toward the restriction 218. This increase in operating drilling fluid pressure may increase the pad force against the wellbore wall 232 by the steering pad 226. The increase in pad force may increase the operating dogleg. In some embodiments, the increase in pad force may cause the operating dogleg to be closer to the target dogleg, or to reach the target dogleg. Drilling at the target dogleg may reduce the amount of drilling required to reach a target formation and/or longitudinal location, thereby reducing the total cost of the wellbore.

Figure 3:
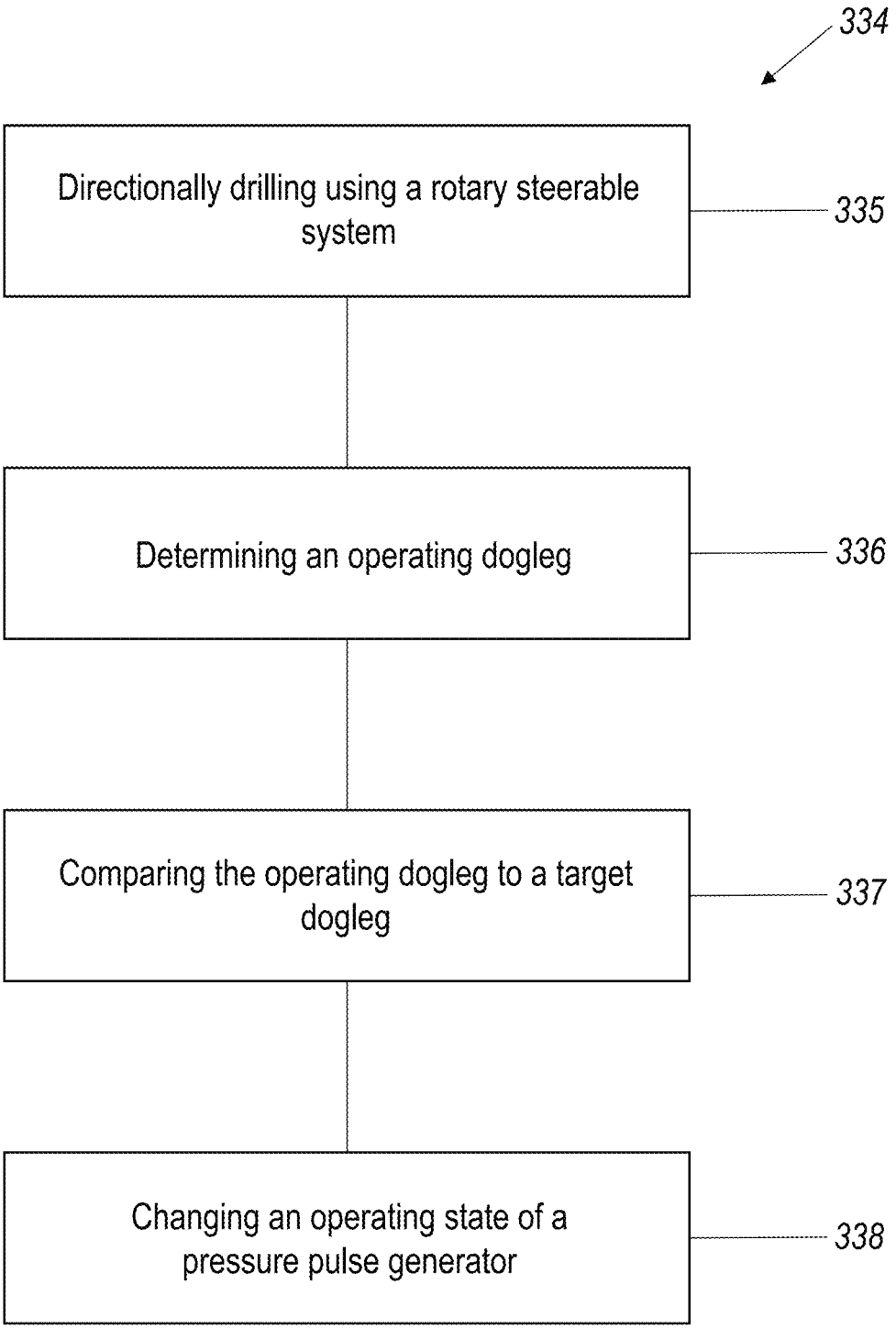
FIG. 3 is a representation of a method for downhole drilling, according to at least one embodiment of the present disclosure.

FIG. 3 is a representation of a method 334 for downhole drilling, according to at least one embodiment of the present disclosure. The method 334 includes directionally drilling using an RSS (e.g., RSS 211 of FIG. 2) at 335. In some embodiments, one or more steering pads (e.g., steering pad 226 of FIG. 2) of the RSS may push on a wellbore wall with a pad force. The pad force may be determined by a drilling fluid pressure of a fluid flow flowing through the RSS. A digital valve may open and close a hydraulic pathway to the steering pad.

The method 334 may include determining an operating dogleg at 336. In some embodiments, determining the operating dogleg may include measuring the operating dogleg. For example, an MWD or LWD tool may include trajectory sensors. The MWD or LWD may measure an inclination of the wellbore using the trajectory sensors. The inclination of the wellbore may be used to determine the operating dogleg. In some embodiments, the inclination may be compared to historical drilling data to determine how fast the inclination is changing per 100 feet drilled to determine the operating dogleg. In some embodiments, the inclination may be compared to a target inclination at the location the inclination was measured to determine the operating dogleg. In some embodiments, the operating dogleg may be received from another source. For example, the operating dogleg may be received from another downhole tool, from the surface, from a sensor, from any other location, and combinations thereof.

In some embodiments, the operating dogleg may be compared to a target dogleg at 337. If the operating dogleg is different than the target dogleg, then an operating state of the pressure pulse generator may be changed at 338. In this manner, a severity of the dogleg may be changed based on the operating state of the pressure pulse generator. In some embodiments, the operating dogleg may be different from the target dogleg because of changes in drilling conditions, such as the hardness of the formation against which the steering pad is pushing. In some embodiments, if the operating dogleg is less than the target dogleg, then the pressure pulse generator may be placed into a pass-through mode. Actuating the pressure pulse generator may create peaks and troughs in the drilling fluid pressure. Actuating steering pads in the troughs of this actuation may result in a reduced pressure of the steering pad against the formation, which may result in a reduced dogleg severity. Actuating steering pads in the peaks of this actuation may not increase the pressure on the formation to increase the dogleg severity enough to counteract the reduced dogleg severity caused by the trough. By placing the pressure pulse generator in the pass-through mode, the peaks and troughs may be removed, and the drilling fluid pressure may remain constant. This may allow the steering system to steer at the design dogleg severity.

Furthermore, the pass-through mode of the pressure pulse generator may reduce the pressure drop at the pressure pulse generator, which may increase the pressure available for the RSS to use for steering. Increasing the pressure available for the RSS to use for steering may increase the pad force applied by the steering pad against the wellbore wall, which may increase the severity of the dogleg. Thus, the drilling fluid pressure of the fluid flow may be increased past the design drilling fluid pressure without increasing the pressure and/or flow rate of the surface pumps. Accordingly, if the design fluid pressure is considered 100% of the drilling fluid pressure, then, by placing the mud pulse generator in pass-through mode, the drilling fluid pressure may be increased to 100+%, including 101%, 102%, 105%, 110%, and more.

In some embodiments, if the determined operating dogleg is greater than the target dogleg, and the pressure pulse generator is in the pass-through mode, the pressure pulse generator may be turned back on (e.g., begin generating pressure pulses). In this manner, the pressure pulse generator may only be turned off (e.g., placed in the pass-through mode) when the operating dogleg is less than the target dogleg.

Figure 4:
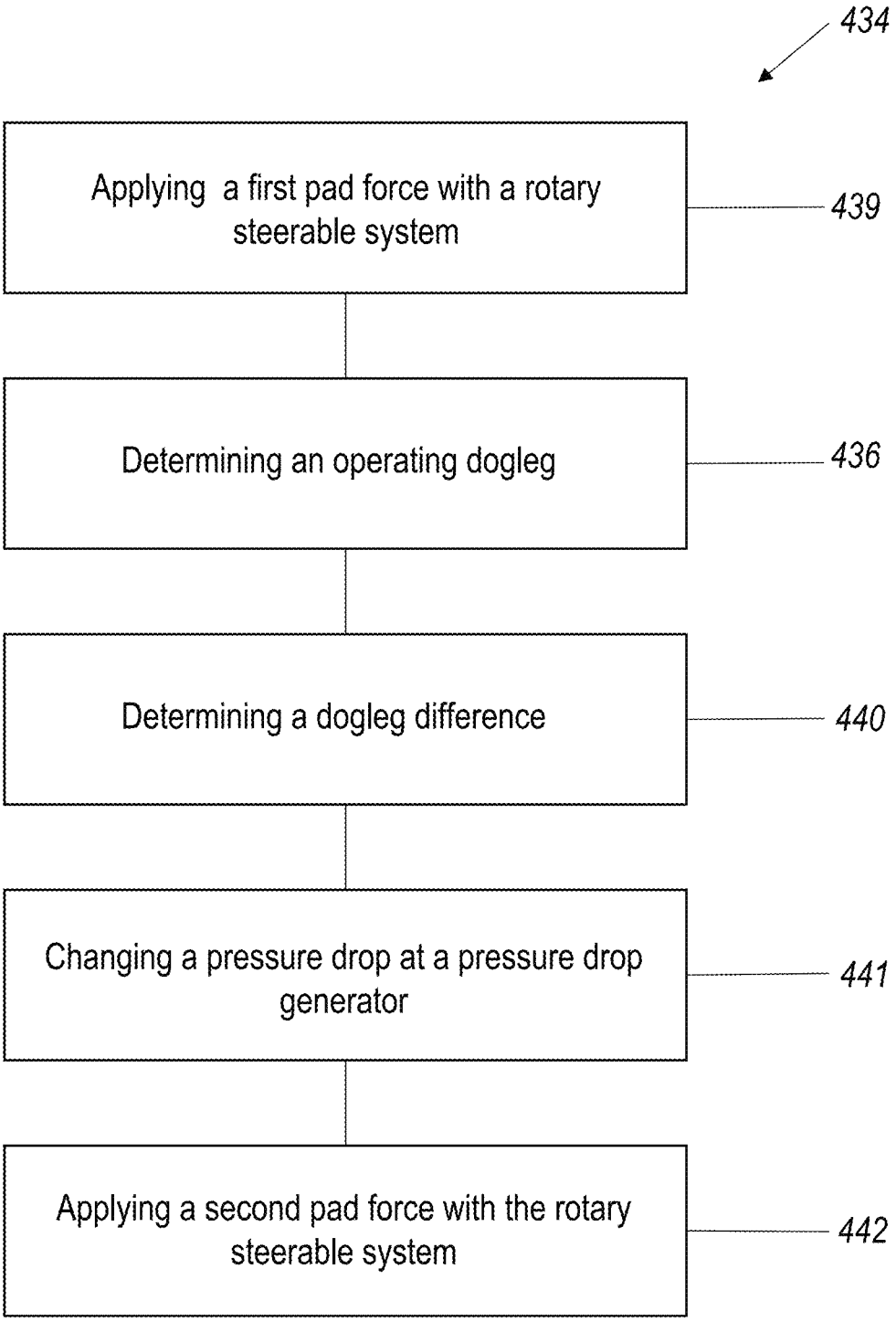
FIG. 4 is a representation of another method for downhole drilling, according to at least one embodiment of the present disclosure.

FIG. 4 is a representation of a method 434 for downhole drilling, according to at least one embodiment of the present disclosure. The method 434 includes applying a first pad force to a wellbore wall with a rotary steerable system at 439. The first pad force may be applied to the wellbore wall with a steering pad of the rotary steerable system. The first pad force may be dependent upon the operating drilling fluid pressure. When the drilling fluid pressure is at a design drilling fluid pressure, the first pad force may be at a design pad force. The design pad force may be the maximum available pad force to the wellbore wall by the steering pad when the surface pumps are operating at full capacity and a pressure pulse generator is generating pressure pulses. In some embodiments, each steering pad of a plurality of steering pads on the RSS may push against the wellbore wall with the same pad force.

In some embodiments, the method 434 may include determining an operating dogleg that is associated with the first pad force. The operating dogleg may be based on drilling conditions. For example, the hardness of the formation may have an effect on the operating dogleg. A harder formation may be harder to turn a dogleg in, and therefore a greater pad force may be required to push the bit with the target dogleg. In some embodiments, the operating dogleg may be determined from the RSS. In other words, the RSS may include one or more sensors configured to determine the operating dogleg.

In some embodiments, the method 434 may include determining a dogleg difference between the operating dogleg and a target dogleg at 440. In some embodiments, the dogleg difference may be determined at the location of the RSS, based on the location of the determined operating dogleg. If the operating dogleg severity at the maximum steering setting is less than the target dogleg severity, then the system may need to place the pressure pulse generator in a pass-through mode.

In some embodiments, based on the dogleg difference, a pressure drop at a pressure pulse generator may be changed at 441. For example, if the dogleg difference is outside of (e.g., less than) a dogleg difference tolerance of 90%, then the pressure drop at the pressure pulse generator may be reduced, such as by placing the pressure pulse generator in the pass-through mode. In some embodiments, reducing the pressure drop at the pressure pulse generator may include pausing operation of the pressure pulse generator if the dogleg difference is outside of the dogleg difference tolerance. In some embodiments, if the dogleg difference tolerance is greater than 100%, and the pressure pulse generator is in the pass-through mode, or a reduced communication mode, then the pressure drop at the pressure pulse generator may be increased, such as by resuming or increasing pressure pulse generation at the pressure pulse generator.

In some embodiments, the method 434 may include applying a second pad force to the wellbore wall with the rotary steerable system based on the change in pressure drop at the pressure pulse generator at 442. The second pad force may be different than the first pad force. In some embodiments, the second pad force may be larger than the first pad force. For example, if the pressure drop at the pressure pulse generator is reduced, then the pressure available to the RSS may be increased, which may increase the first pad force to the second pad force. In some embodiments, applying the increased second pad force may increase the severity of the operating dogleg. In some embodiments, the severity of the operating dogleg may be increased to the target dogleg or above the target dogleg.

In some embodiments, the operating state (and therefore the pressure drop) at the pressure pulse generator may be changed based on measurements taken at the pressure pulse generator. In other words, the pressure pulse generator may include sensors and a processor which may measure the operating dogleg and compare it to the target dogleg to determine the dogleg difference. The processor may further determine, based on the dogleg difference, whether or not to change the operating state of the pressure pulse generator. In some embodiments, this analysis may be done remotely from the pressure pulse generator. For example, this analysis may be done by an MWD or an LWD. The MWD may determine the operating dogleg, compare it to the target dogleg, and send the results to the pressure pulse generator. In some embodiments, the MWD may send instructions to the pressure pulse generator to change its operating status. In some embodiments, the MWD may communicate with the pressure pulse generator by wired communication, wireless electromagnetic communication, pressure pulse, or any other downhole communication method. In some embodiments, the RSS may determine the operating dogleg, determine the dogleg difference, and send the results instructions to the pressure pulse generator to change its operating state. In some embodiments, one or both of the operating dogleg and the dogleg difference may be determined at the surface, and the surface may transmit instructions to the pressure pulse generator to change its operating state.

Figure 5:
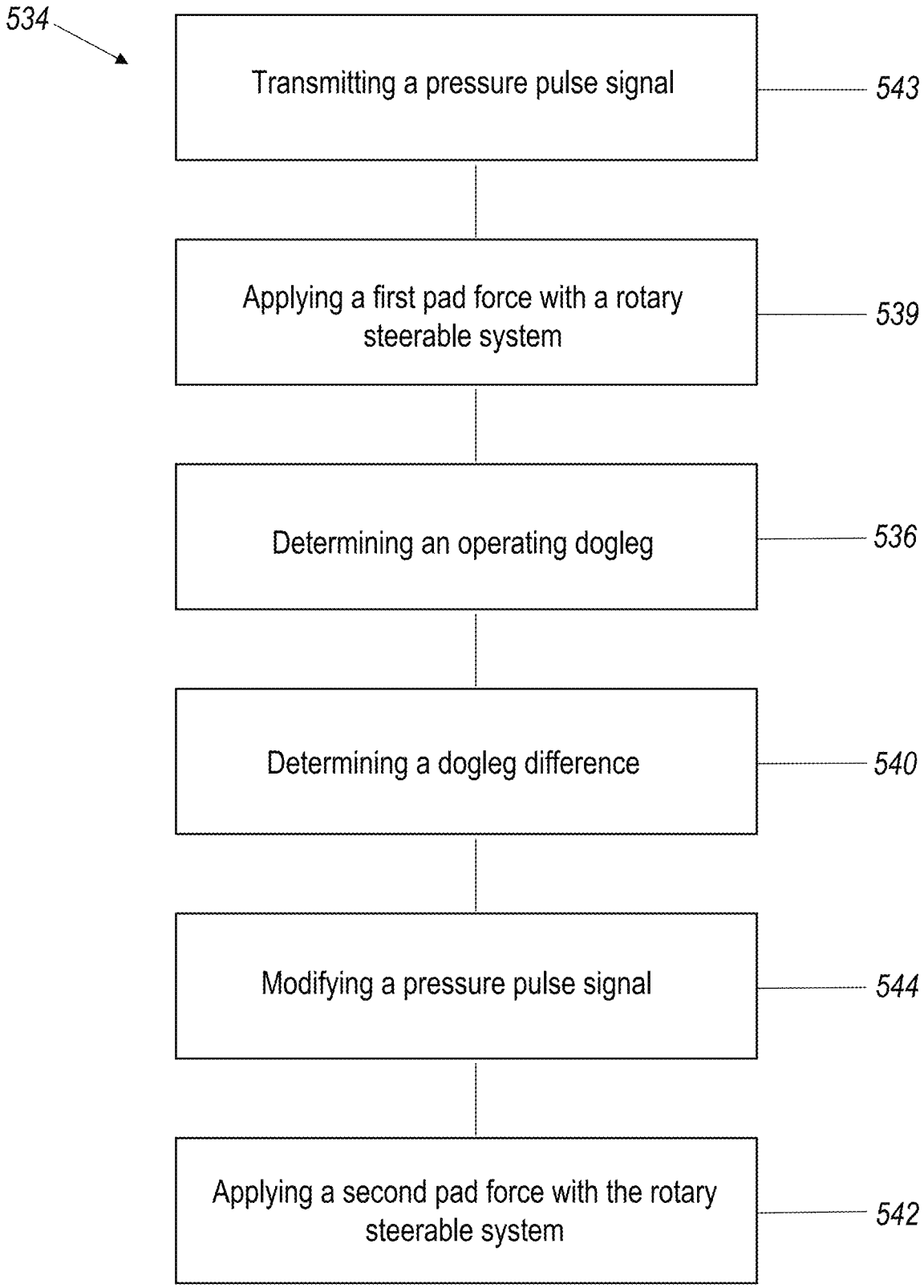
FIG. 5 is a representation of yet another method for downhole drilling, according to at least one embodiment of the present disclosure.

FIG. 5 is a representation of a method 534 for downhole drilling, according to at least one embodiment of the present disclosure. The method 534 includes transmitting a pressure signal using a pressure pulse generator at 543. The pressure pulse signal may be transmitted with a pressure drop at the pressure pulse generator. The method 534 may include applying a first pad force to a wellbore wall with an RSS at 539. The first pad force may be associated with a drilling fluid pressure at the RSS. The first pad force may be a maximum available pad force when the surface pumps are operating at capacity and the pressure pulse generator is generating pressure pulses.

The method 534 may include determining an operating dogleg at 536. The operating dog may be compared to a target dogleg to determine a dogleg difference at 540. In some embodiments, if the dogleg difference is outside of a dogleg difference tolerance, the pressure pulse signal may be modified to change the pressure drop at the pressure pulse difference at 544. In some embodiments, modifying the pressure pulse signal may include pausing transmission of the pressure pulse signal. This may reduce the pressure drop at the pressure pulse generator and cause a second pad force to be applied to the wellbore wall at 542. The second pad force may be different from the first pad force. For example, if pressure pulses are paused at the pressure pulse generator, the second pad force may be greater than the first pad force.

In some embodiments, modifying the pressure pulse signal may include reducing the amount of data transmitted by the pressure pulse generator. For example, modifying the pressure pulse signal may include reducing the amount of data transmitted by the pressure pulse generator to critical data, such as azimuth, inclination, or other information determined to be critical by an operator. In some embodiments, modifying the pressure pulse signal may include storing information to be transmitted when the transmission of the pressure pulse signal is resumed. In some embodiments, modifying the pressure pulse signal may include transmitting every other survey measurement, or some other periodic transmission of survey measurements or other data.

In some embodiments, the pressure pulse signal may be paused mid-signal. When the pressure pulse generator receives an instruction to modify or pause the pressure pulse signal, the pressure pulse generator may immediately stop transmitting the pressure pulse signal. When a receiver receiving the pressure pulse signal hears a break in transmission, the receiver may wait until the pressure pulse signal resumes. When the pressure pulse signal resumes, the pressure pulse generator may pick up where it left off, and the receiver may remove the gap from the pressure pulse signal to decode the signal.

In some embodiments, the pressure pulse generator may transmit a "stop code" before pausing transmission of the pressure pulse signal. The stop code may indicate to any receiver receiving the pressure pulse signal that the pressure pulse signal is about to be paused. When the pressure pulse generator begins transmitting the pressure pulse signal again, the pressure pulse generator may transmit a "start code" before picking up the transmission where it left off. In some embodiments, the pressure pulse generator may finish a pressure pulse signal before pausing transmission. In some embodiments, the pressure pulse generator may repeat some or all of the interrupted signal after resuming transmission.

In some embodiments, the pressure pulse generator may resume the pressure pulse signal when the dogleg difference is within the dogleg difference tolerance. In this manner, the pressure pulse generator may give pressure priority to the RSS. In other words, the RSS may have priority to downhole drilling pressure over the pressure pulse generator. This may help the operating dogleg to remain close to the target dogleg, which may keep the wellbore on the target trajectory, thereby saving time and money.

Figure 6:
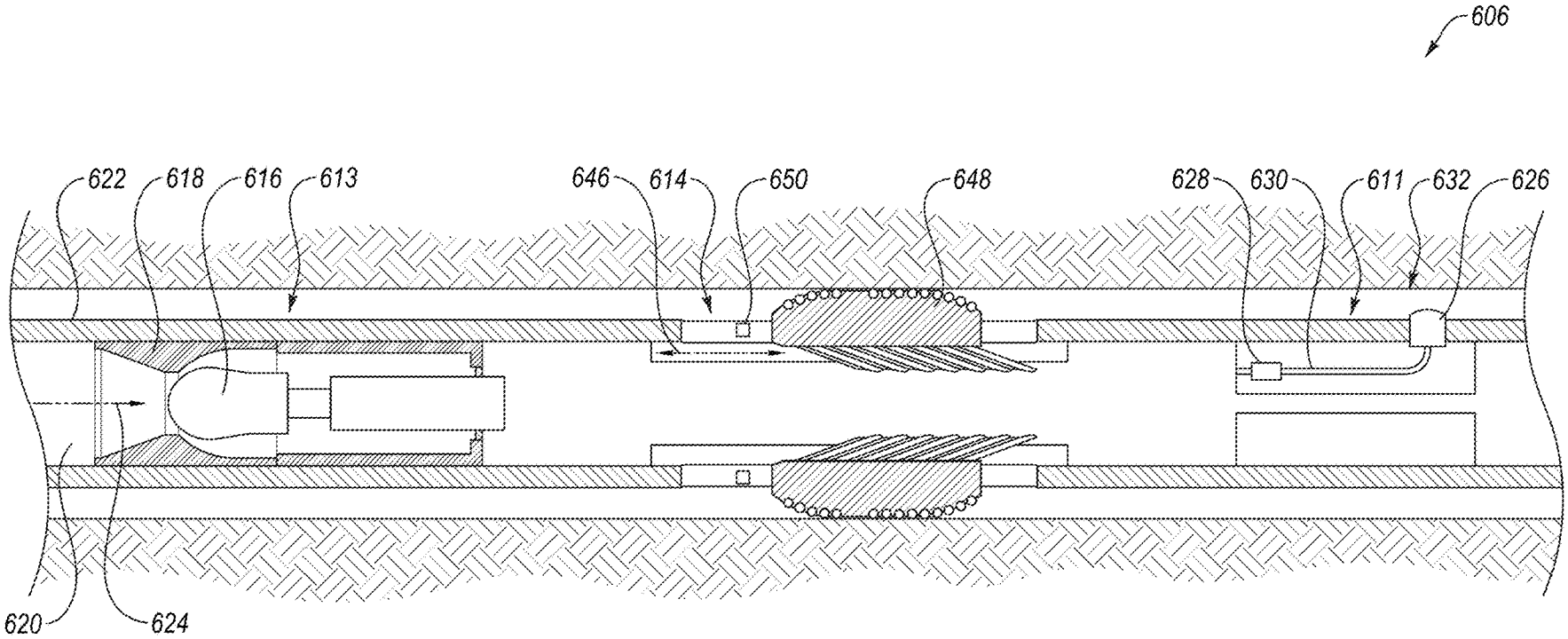
FIG. 6 is a representation of a bottomhole assembly, according to at least one embodiment of the present disclosure.

FIG. 6 is a representation of a portion of a BHA 606, according to at least one embodiment of the present disclosure. The BHA 606 includes a pressure pulse generator 613. The pressure pulse generator 613 may include a flow restrictor 616. The flow restrictor 616 may be longitudinally movable relative to a restriction 618 in the bore 620 of a housing 622. As the flow restrictor 616 moves closer to the restriction 618, a fluid flow 624 through the bore 620 may be impeded, increasing the drilling fluid pressure. By moving the flow restrictor 616 back and forth relative to the restriction 618, changes in the flow rate and/or hydraulic pressure of the fluid flow 624 may be made.

The BHA 606 includes an RSS 611. The RSS 611 includes a plurality of steering pads 626. A digital valve 628 may be connected to the steering pad 626 with a hydraulic pathway 630. The digital valve 628 may be electronically controlled. In a first position, the digital valve 628 may open the hydraulic pathway 630 to the steering pad 626. This may cause a portion of the fluid flow 624 to be diverted into the hydraulic pathway 630 and to push on the steering pad 626. This may extend the steering pad 626 radially outward from the RSS 611. The steering pad 626 may contact a wellbore wall 632 with a pad force. This may push on the RSS 611, which may push the bit (e.g., bit 110 of FIG. 1) in the direction opposite the pad force. By timing the actuation of the digital valves 628 to open when the steering pad 626 is at a specified rotational position, the bit may push on a trajectory, which may cause a dogleg in the wellbore. In some embodiments, actuating the digital valve 628 (and the steering pad 626) may change the pressure of the fluid flow 624.

The BHA 606 further includes a downhole tool 614. The downhole tool 614 may be mud-actuated (e.g., drilling-fluid actuated) downhole tool 614. For example, in the embodiment shown, the downhole tool 614 is a mud-actuated reamer. However, it should be understood that the downhole tool 614 may include any mud-actuated downhole tools, including section mills, casing cutters, turbines, motors, other downhole tools, and combinations thereof. In some embodiments, the downhole tool 614 may be a moving component of a downhole tool 614, such as a piston, valve, shuttle, sleeve, pathway, other moving component, and combinations thereof.

In some embodiments, the downhole tool 614 may move between a first position and a second position. The downhole tool 614 follows an actuation path 646. In some embodiments, the actuation path 646 may include the path that a moving component of the downhole tool 614 follows. For example, the reamer block 648 of FIG. 6 may follow the actuation path 646. As the reamer block 648 moves uphole (e.g., to the left in FIG. 6), the reamer block 648 may extend pass the housing 622. As the reamer block 648 moves downhole (e.g., to the right in FIG. 6), the reamer block 648 may retract into the housing 622.

In some embodiments, debris may become caught in the actuation path 646. This may prevent the reamer block 648 from moving along the actuation path 646. Indeed, in some embodiments, the reamer block 648 may become stuck in the actuation path 646. Accordingly, the reamer block 648 may not fully extend or retract at the appropriate time. This may cause damage to the wellbore and/or to the downhole tool 614 (including the reamer block 648).

In some embodiments, an increase in drilling fluid pressure of the fluid flow 624 may clear the actuation path and/or unstick the reamer block 648. In some embodiments, the drilling fluid pressure may be increased by increasing the output of the surface pumps. In some embodiments, the drilling fluid pressure may be increased by actuating the pressure pulse generator and/or the RSS 611. This may temporarily spike or increase the drilling fluid pressure. In some embodiments, the increase in drilling fluid pressure may dislodge the debris and/or unstick the downhole tool 614.

In some embodiments, actuating the RSS 611 may include actuating a single steering pad 626 (by actuating the associated digital valve 628) of the plurality of steering pads on the RSS 611. In some embodiments, actuating the RSS 611 may include actuating more than one steering pad 626 (and the associated digital valve 628) of the plurality of steering pads 626 on the RSS 611 at the same time. In some embodiments, actuating the RSS 611 may include actuating each steering pad 626 (and each associated digital valve 628) of the plurality of steering pads 626 at the same time. The more steering pads 626 actuated, the higher the spike in drilling fluid pressure.

In some embodiments, actuating the pressure pulse generator 613 may include moving the flow restrictor 616 longitudinally toward the restriction 618. In some embodiments, the pressure pulse generator 613 and the RSS 611 may be actuated simultaneously. Simultaneous actuation of the pressure pulse generator 613 and the RSS 611 may include actuating them at the same time. In some embodiments, actuating the pressure pulse generator 613 and the RSS 611 at the same time may mean starting actuation at the same time, overlapping actuation, ending actuation at the same time, or any other simultaneous actuation. In some embodiments, the change in pressure of the fluid flow 624 may take a period of time to travel to the downhole tool 614, and simultaneous actuation of the pressure pulse generator 613 may include timing the actuation of the pressure pulse generator 613 and the RSS 611 so that the resulting increase in pressure will reach the downhole tool 614 at the same time.

In some embodiments, the operating position of the downhole tool 614 (e.g., the reamer block 648 in the embodiment shown) may be determined using a sensor 650. The sensor 650 may be any type of sensor capable of determining the operating position of the downhole tool 614. For example, the sensor 650 may be a position sensor. The position sensor may sense the position of the reamer block 648, and a determination may be made if the reamer block 648 is in position. In some examples, the sensor 650 may be a pressure sensor. The downhole tool 614 may include an operating pressure, and the sensor 650 may determine if the measured pressure is the operating pressure. In some embodiments, the sensor 650 may include both a position sensor and a pressure sensor. In this manner, both the measured position and the measured pressure may be used to determine whether the downhole tool 614 is clogged and/or stuck.

Figure 7:
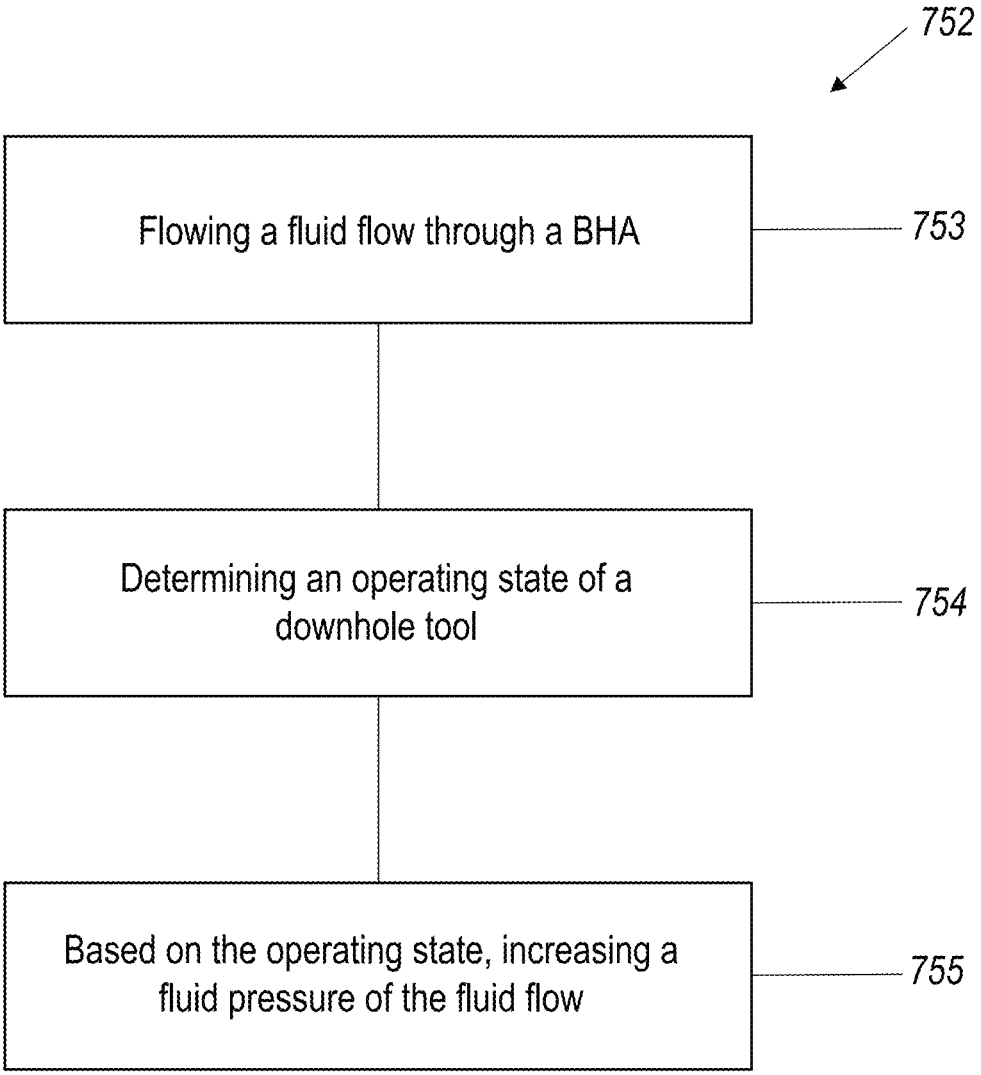
FIG. 7 is a representation of a method for downhole drilling, according to at least one embodiment of the present disclosure.

FIG. 7 is a representation of a method 752 for downhole drilling, according to at least one embodiment of the present disclosure. The method 752 includes flowing a fluid flow through a BHA at 753. The BHA may include a pressure pulse generator, a rotary steerable system, and a mud-actuated downhole tool. The fluid flow has a drilling fluid pressure. In some embodiments, the drilling fluid pressure may be a design drilling fluid pressure (e.g., the drilling fluid pressure downhole when the surface pumps are operating at full capacity and the pressure pulse generator is generating pressure pulses).

The method 752 includes determining an operating state of a downhole tool at 754. In some embodiments, determining the operating state of the downhole tool may include determining that the downhole tool is clogged. In other words, determining the operating state of the downhole tool may include determining that debris block at least a portion of an actuating path or a hydraulic pathway of the downhole tool. This may cause the downhole tool to become stuck and/or for the downhole tool to not fully actuate.

Based on the operating state, the fluid pressure of the fluid flow may be increased at 755. The fluid pressure of the fluid flow may be increased by simultaneously actuating the pressure pulse generator and one or more steering pads from the RSS. In some embodiments, actuating the pressure pulse generator may include moving the pressure pulse generator into a high-pressure state (e.g., with the flow restrictor moved close to the restriction). In some embodiments, one, more than one, or all of the steering pads of the RSS may be actuated. By simultaneously actuating the pressure pulse generator and one or more steering pads of the RSS, the drilling fluid pressure may be increased over the design drilling fluid pressure. In some embodiments, this may unclog the downhole tool. For example, increasing the drilling fluid pressure may remove any debris that have collected in the actuation path and/or a hydraulic pathway. In some examples, increasing the drilling fluid pressure may unstick a moving part of the downhole tool. In some examples, increasing the drilling fluid pressure may cause the moving part of the downhole tool to push any debris in the actuation path out of the way. Unclogging (or unsticking) the downhole tool may help to prevent damage to the downhole tool and/or the wellbore. In some embodiments, unclogging or unsticking a downhole tool may prevent tripping the downhole tool out of the wellbore for servicing, thereby saving time and money.

Figure 8:
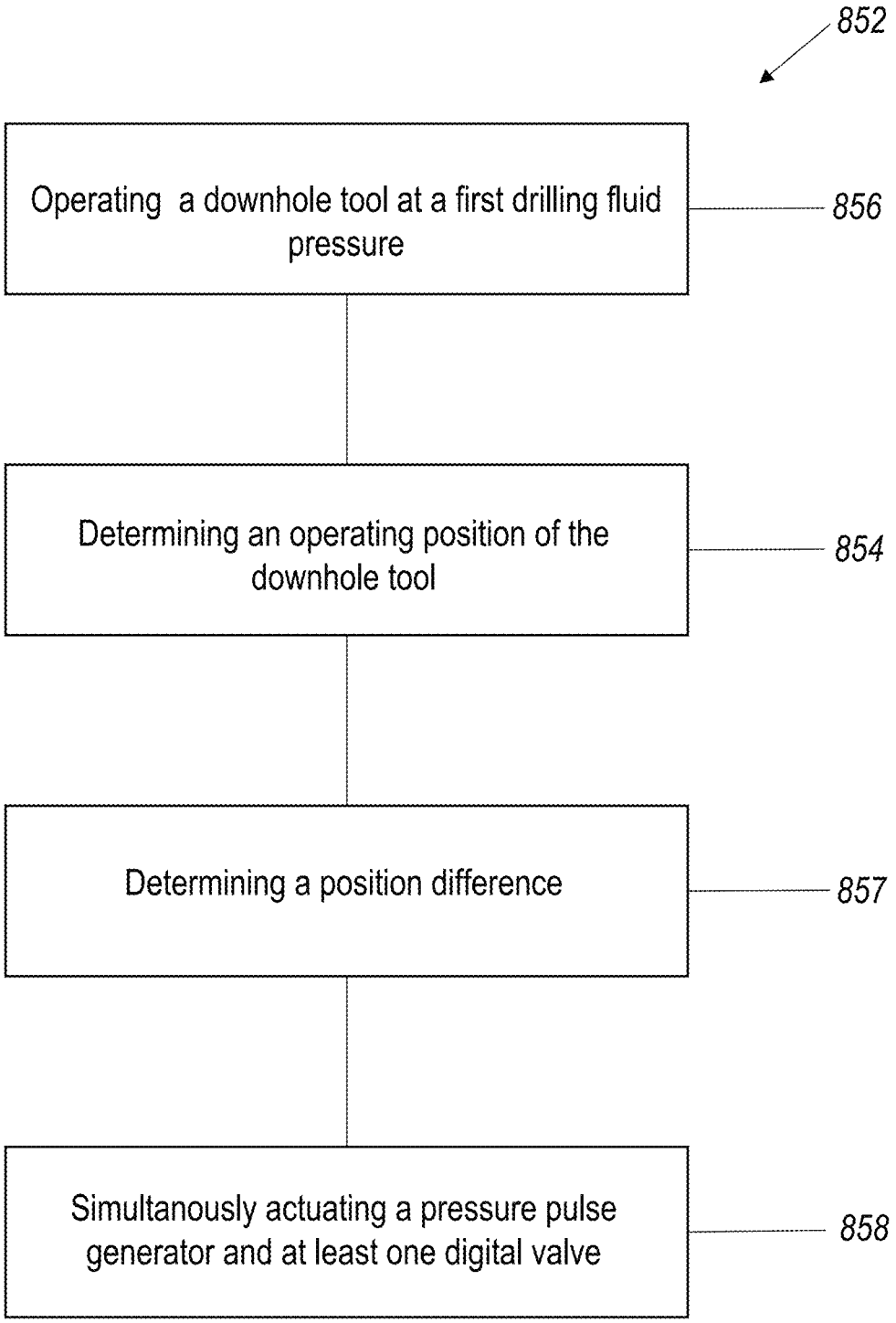
FIG. 8 is a representation of another method for downhole drilling, according to at least one embodiment of the present disclosure.

FIG. 8 is a representation of a method 852 for downhole drilling, according to at least one embodiment of the present disclosure. The method 852 includes operating a downhole tool at a first drilling fluid pressure (e.g., an operating drilling fluid pressure) at 856. Operating the downhole tool may include actuating a downhole tool, opening or closing a valve, extending or retracting a piston, moving a movable component of the downhole tool, and combinations thereof. In some embodiments, the method 852 may include determining an operating position of the downhole tool at 854. The downhole tool may include more than one tool position. Operating the downhole tool may include changing the downhole tool between a first tool position and a second tool position. The downhole tool has a target tool position based on the operating drilling fluid pressure. Accordingly, the downhole tool should be in the target position when operating at the operating drilling fluid pressure.

In some embodiments, determining the operating position of the downhole tool may include sensing the operating position of the downhole tool. For example, the operating position of the downhole tool may be sensed using a position sensor. In some examples, the operating position of the downhole tool may be inferred using a pressure sensor. For example, in the target position, a mud-actuated downhole tool may have a target fluid pressure, and the operating position may be determined by the measured fluid pressure compared to the target fluid pressure. In some embodiments, both the position sensor and the pressure sensor may be used to determine the operating position of the downhole tool. For example, if the actuation path of the downhole tool is blocked and/or clogged by debris, then the measured pressure may be higher than if the actuation path is not blocked. Combined with the position measured from the position sensor, the existence and the extent of a clog or blockage may be determined based on the determined position of the downhole tool.

The method 852 may include determining a position difference between the operating position and the target position of the downhole tool at 857. If the operating position is not the same as the target position, then there is a position difference, and the existence of a clog or blockage may be determined and/or inferred.

In some embodiments, the operating position may be compared to past operating position determinations. If the operating position has not changed based on changed drilling fluid pressure, then the downhole tool may be stuck. In some embodiments, the downhole tool may be stuck in the open position, the closed position, or in a position between the open position and the closed position.

In some embodiments, if the position difference is outside of the position difference tolerance, then the pressure pulse generator and at least one steering pad of the plurality of steering pads may be simultaneously actuated at 858. Simultaneously actuating the pressure pulse generator and the at least one steering pad may increase the first drilling fluid pressure (e.g., the operating drilling fluid pressure) to a second drilling fluid pressure (e.g., an unclogging drilling fluid pressure). In some embodiments, simultaneously actuating the pressure pulse generator and the at least one steering pad includes actuating both the pressure pulse generator and the at least one steering pad at the same time. For example, an electronic connection (e.g., wired and/or electromagnetic) between the pressure pulse generator and the RSS may allow the pressure pulse generator and the RSS to coordinate the spike in drilling fluid pressure. In some embodiments, the RSS and the pressure pulse generator may coordinate the timing of the spike in drilling fluid pressure by pressure pulse. For example, if the position difference is outside of the position difference tolerance, then pressure pulse generator may send a signal to the RSS (or vice versa). The signal may include instructions for the time and/or duration of the pressure spike.

In some embodiments, simultaneously actuating the pressure pulse generator and the at least one steering pad may include actuating more than one steering pad of the plurality of steering pads. In some embodiments, each steering pad of the plurality of steering pads may be actuated. In some embodiments, simultaneously actuating the pressure pulse generator may remove debris from the actuating path and/or hydraulic pathway of the downhole tool. For example, the pressure spike may dislodge the debris, thereby unclogging the actuating path and/or the hydraulic pathway. In some embodiments, the pressure spike may force the moving component of the downhole tool to move, unsticking a stuck downhole component (and dislodging any debris in the actuation pathway).

In some embodiments, simultaneously actuating the pressure pulse generator and the at least one steering pad may include simultaneously actuating the pressure pulse generator and the at least one steering pad for an unclogging period. In some embodiments, the unclogging period may be the length of time that both the pressure pulse generator and the at least one steering pad are actuated. In other words, the unclogging period may be the length of time that the drilling fluid pressure is spiked. In some embodiments, the unclogging period may be until the operating position of the downhole tool is within the position difference tolerance. In some embodiments, the unclogging period may be fixed. In some embodiments, the unclogging period may be in a range having an upper value, a lower value, or upper and lower values including any of 0.01 s, 0.05 s, 0.1 s, 0.5 s, 1 s, 5 s, 10 s, 15 s, 20 s, 30 s, 45 s, 60 s, 120 s, 600 s, or any value therebetween. For example, the unclogging period may be greater than 0.01 s. In another example, the unclogging period may be less than 600 s. In yet other examples, the unclogging period may be any value in a range between 0.01 s and 600 s. In some embodiments, it may be critical that the unclogging period is greater than 5 s to sufficiently unclog the actuation pathway.

In some embodiments, when the position difference is back within the position difference tolerance, at least one of the pressure pulse generator or the at least one steering pad may be deactivated. In other words, when the downhole tool moves to the target position, the pressure pulse generator may resume transmitting pressure pulses and the one or more steering pads on the RSS may resume actuating to steer the bit. In this manner, downhole drilling activities may resume with the downhole tool in operating condition (e.g., unstuck).

In some embodiments, the actuating pathway may clog with debris each time the downhole tool is shut down. Accordingly, the downhole tool may need to be unclogged at startup each time the downhole drilling system is started, and/or each time the downhole tool is actuated. In some embodiments, the actuating path of the downhole tool may be regularly flushed out. For example, the pressure pulse generator and the RSS may periodically simultaneously actuate to clear the actuating path of any accumulated debris. This may help to prevent the downhole tool from sticking, thereby saving time and money.

Figure 9:
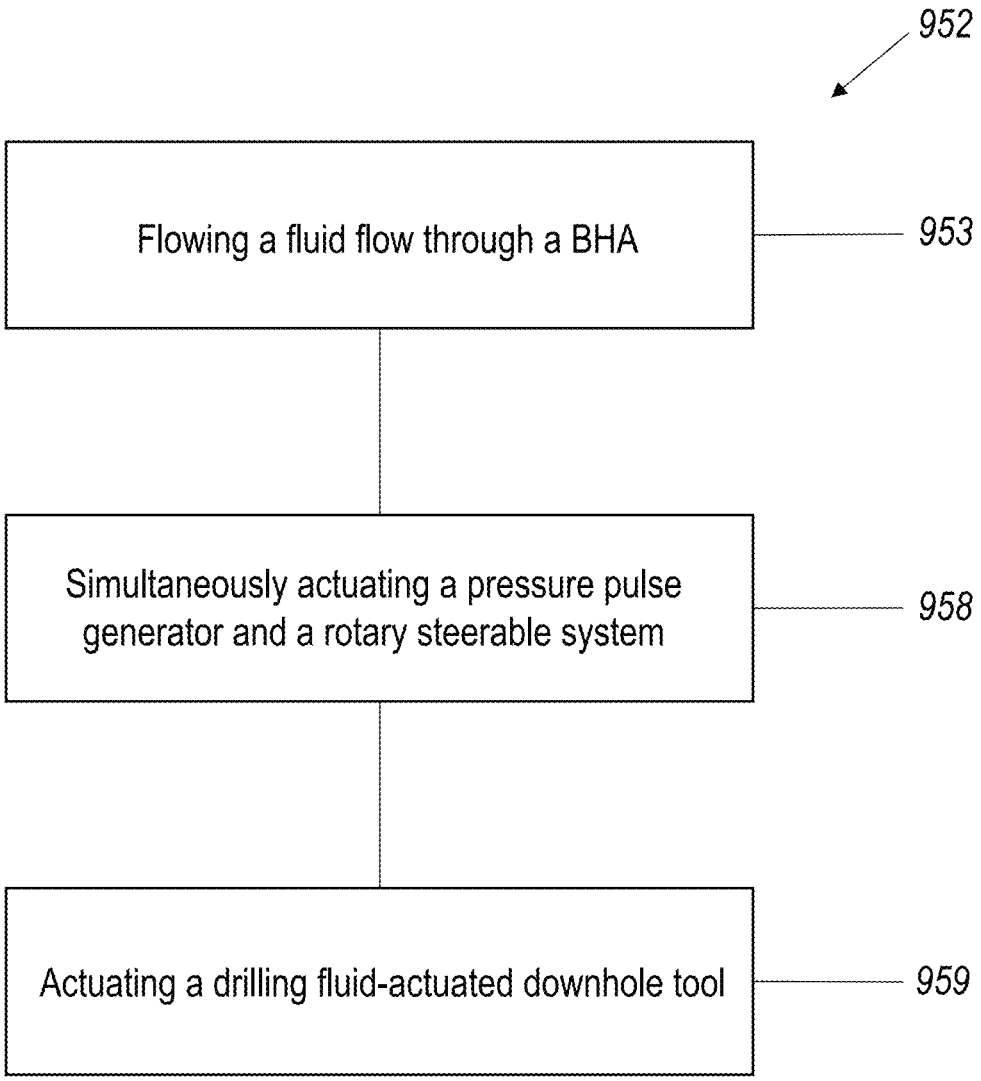
FIG. 9 is a representation of yet another method for downhole drilling, according to at least one embodiment of the present disclosure.

FIG. 9 is a representation of a method 952 for downhole drilling, according to at least one embodiment of the present disclosure. The method 952 may include flowing a fluid flow through a BHA at 953. The BHA may include a pressure pulse generator, an RSS, and a mud-actuated downhole tool. The fluid flow has a drilling fluid pressure. In some embodiments, the drilling fluid pressure may be a design drilling fluid pressure (e.g., the drilling fluid pressure downhole when the surface pumps are operating at full capacity and the pressure pulse generator is generating pressure pulses).

In some embodiments, an increase in drilling fluid pressure may actuate the downhole tool. To increase the drilling fluid pressure, the pressure pulse generator and the RSS may be simultaneously actuated at 958. This may increase the drilling fluid pressure from the operating fluid pressure to an actuating fluid pressure. In some embodiments, simultaneously actuating the pressure pulse generator and the RSS may include actuating at least one steering pad of a plurality of steering pads on the RSS. In some embodiments, each steering pad of the plurality of steering pads may be actuated. Actuating more steering pads may increase the actuating fluid pressure.

In some embodiments, increasing the drilling fluid pressure to the actuating fluid pressure may actuate a drilling fluid-actuated (e.g., mud-actuated) tool at 959. In some embodiments, actuating the mud-actuated tool may include extending an extendable component of the downhole tool, opening a valve, closing valve, extending a piston, retracting a piston, move another downhole component, and combinations thereof. Simultaneously actuating the pressure pulse generator and the RSS to spike the design drilling fluid pressure to the actuating pressure may reduce the design drilling fluid pressure of the system. This may reduce the size of the surface pumps by requiring a lower flow rate to reach the actuating fluid pressure, which may reduce the overall cost of the downhole drilling system. In some embodiments, this may allow the actuating fluid pressure of the mud-actuated tool to be increased. This may help to prevent accidental actuation of the mud-actuated tool, which may help to prevent damage to the mud-actuated tool and/or the wellbore.

Figure 10:
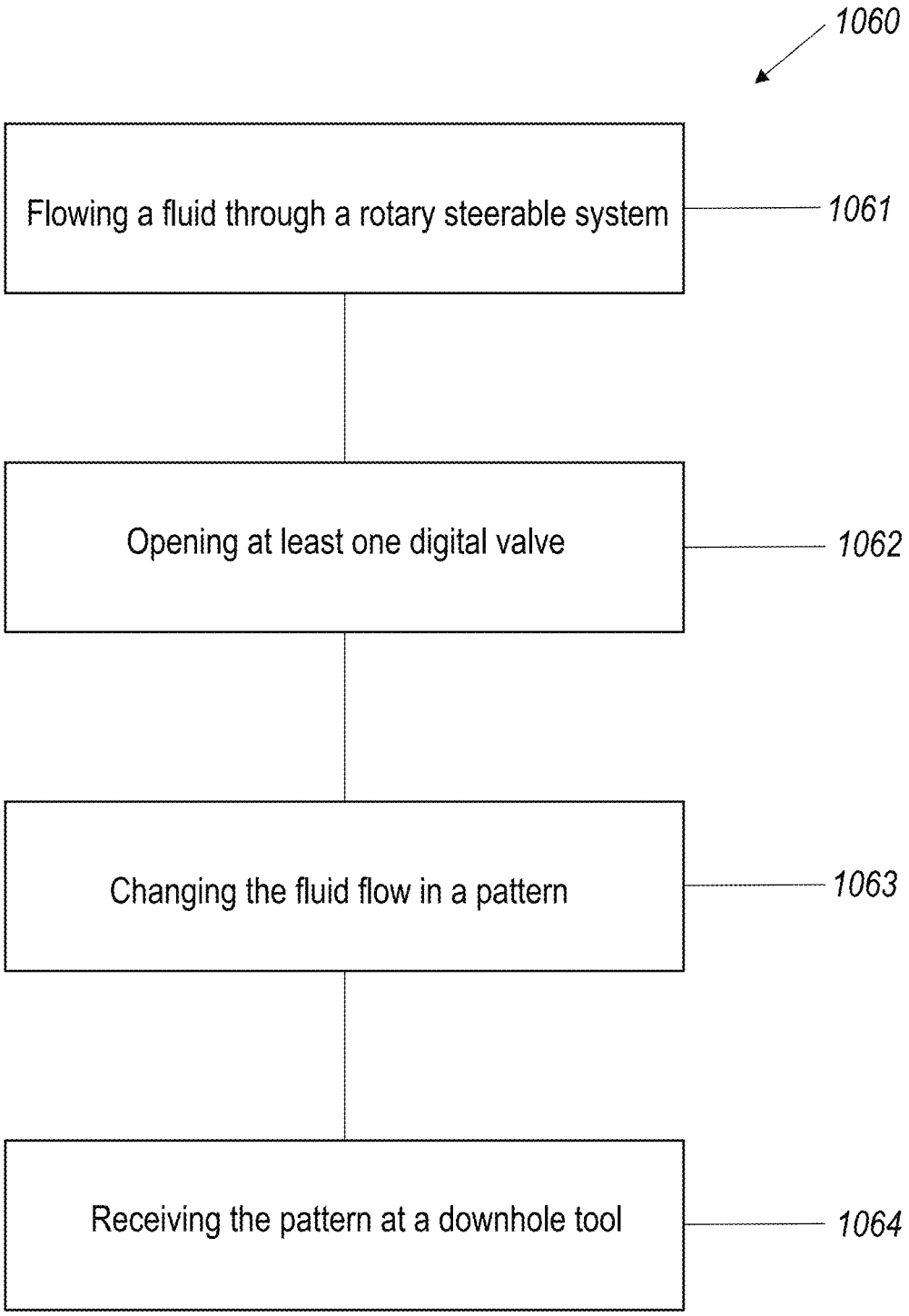
FIG. 10 is a representation of a still further method for downhole drilling, according to at least one embodiment of the present disclosure.

FIG. 10 is a representation of a method 1060 for downhole communication, according to at least one embodiment of the present disclosure. The method includes flowing a fluid flow through an RSS at 1061. The fluid flow may be the same fluid flow that flows through a BHA. Thus, changes in volumetric flow rate, fluid pressure, and other drilling fluid properties may be sensed at both the RSS and at other tools on the BHA, and even at the surface.

In some embodiments, the method 1060 may include opening at least one digital valve of a plurality of digital valves to actuate an associated steering pad at the RSS at 1062. In some embodiments, the digital valve may be opened in a pattern, the pattern including encoded data. The method 1060 may include changing the fluid flow in response to opening the at least one digital valve at 1063. In some embodiments, the changes in the fluid flow may include changes in drilling fluid pressure, changes in volumetric flow rate, or other changes. In this manner, the steering pads of the RSS may act as a pressure pulse generator. In other words, the RSS may generate a pressure pulse signal by selectively actuating the steering pads.

In some embodiments, the pattern may be received at a downhole tool based on changes in the flow rate at 1064. In some embodiments, the downhole tool may be an MWD, an LWD, a pressure pulse generator, or any other downhole tool. In some embodiments, the pattern may be received based on changes in the volumetric flow rate. In some embodiments, the pattern may be received based on changes in the drilling fluid pressure. In some embodiments, the pattern may be demodulated (e.g., decoded) at the downhole tool. In this manner, the RSS may transmit the encoded data to the downhole tool. This may allow the RSS to communicate with the downhole tool. In some embodiments, pressure pulses from the RSS steering pads may be the primary form of communication from the RSS to the downhole tool. In some embodiments, pressure pulses from the RSS steering pads may be backup communication from the RSS to the downhole tool. For example, RSS may communicate via electromagnetic signal to the downhole tool. However, if the electromagnetic transmitter fails, then the RSS may transmit information, such as a downhole tool status, to the downhole tool.

In some embodiments, a single digital valve may be actuated in the pattern to generate the pressure pulses. In this manner, if the RSS includes three digital valves and associated steering pads, then one digital valve may generate the pressure pulses and the remaining digital valves may be used for downhole steering. In some embodiments, to increase the change in pressure, a plurality of digital valves may be opened simultaneously. In some embodiments, each digital valve of the plurality of digital valves may be opened to maximize the change in pressure in the pressure pulses.

In some embodiments, the digital valves of the plurality of digital valves may be opened independently. For example, if a single digital valve is being used to communicate, then the RSS may determine, at a specific point in the pattern, which digital valve may be used for steering, and which digital valve may be used for communication. In this manner, the RSS may determine how to communicate with the downhole tool without impacting steering activities. In some embodiments, the RSS may generate pressure pulses when the RSS is steering in a neutral direction (e.g., without dogleg, or without changing the azimuth or inclination). Thus, the digital valve used to form the pressure pulse may be selected based on a pad force by the steering pad to keep the RSS steering in the neutral mode. In some embodiments, the digital valve to be opened may be selected based on a trajectory deviation of the RSS from the neutral direction. In some embodiments, each digital valve in the RSS may be opened in sequence (e.g., by always opening the immediately clockwise or counter-clockwise adjacent digital valve). This may help to steer the RSS, such as in the neutral direction.

Figure 11:
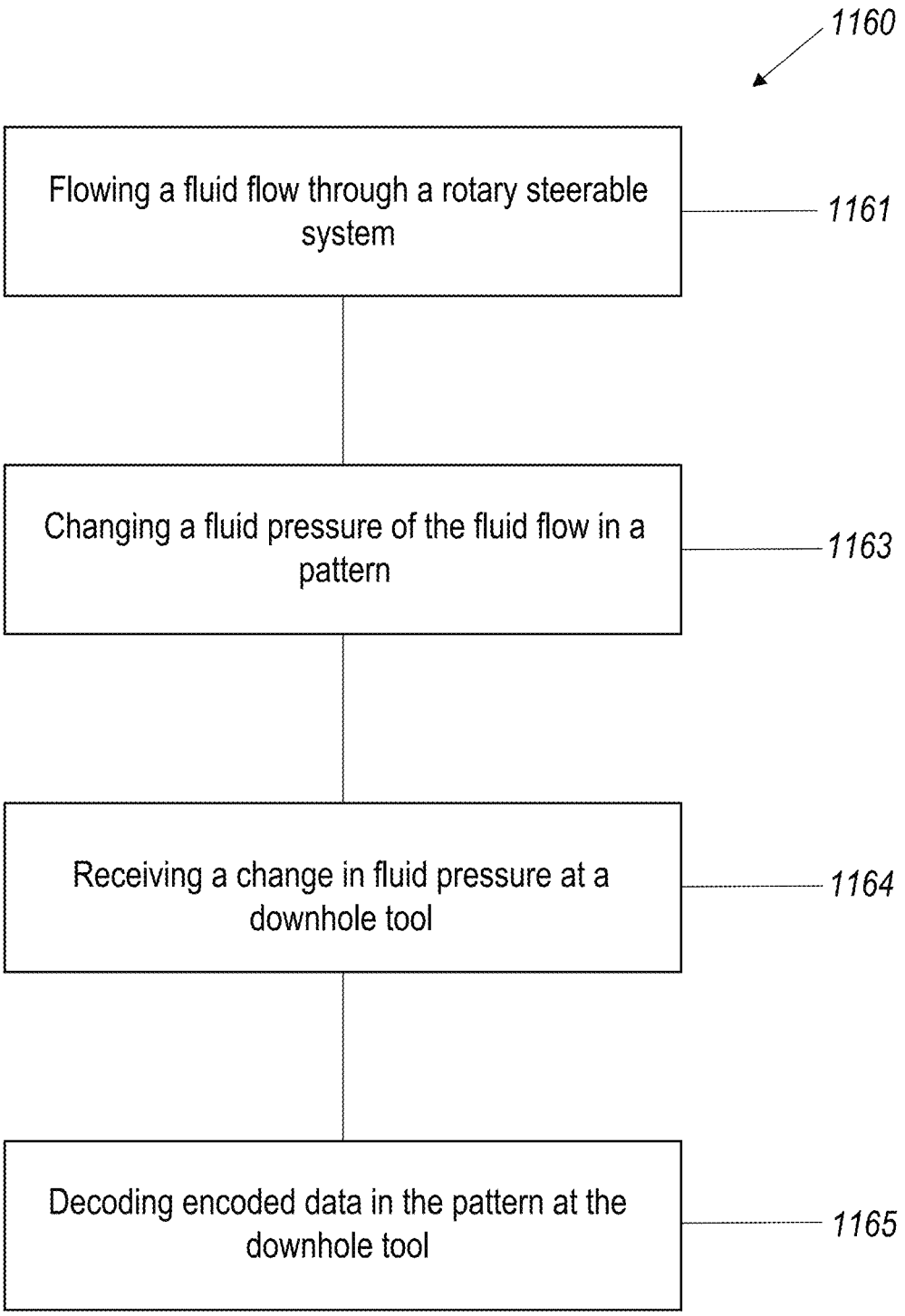
FIG. 11 is a representation of a further method for downhole drilling, according to at least one embodiment of the present disclosure.

FIG. 11 is a representation of a method 1160 for downhole communication, according to at least one embodiment of the present disclosure. In some embodiments, the method includes flowing a fluid flow through an RSS at 1161. The RSS may include a plurality of digital valves that actuate a plurality of steering pads. In some embodiments, the method 1160 may include changing a fluid pressure of the fluid flow at 1163. Changing the fluid pressure of the fluid flow may include actuating at least one digital valve of the plurality of digital valves in a pattern, the pattern including encoded data. Changing the fluid pressure of the fluid flow may further include extending and retracting a steering pad of the plurality of steering pads associated with the digital valves. In some embodiments, the changes in fluid pressure may be between 10 psi and 100 psi.

The method 1160 may include receiving the change in fluid pressure at a downhole tool at 1164. In some embodiments, the pressure pulses may be received at a surface location. The encoded data in the pattern may be decoded at the downhole tool at 1165. In some embodiments, the encoded data may include an instruction for the downhole tool. In some embodiments, the instructions may include instructions to change one or more drilling parameters. For example, the encoded data may include an instruction for a downhole tool to be actuated, for the downhole tool to take a measurement (e.g., azimuth and/or inclination measurement, gamma ray measurement), or other instruction.

In some embodiments, the encoded data may include azimuth and inclination data. For example, the RSS may include one or more sensors. The one or more sensors may measure the azimuth and/or the inclination. The RSS may transmit the azimuth and inclination data to the downhole tool. In some embodiments, the downhole tool may be an MWD, which may include azimuth and inclination sensors. The MWD may compare the received azimuth and inclination data and determine how the trajectory of the wellbore is changing. In some embodiments, the pattern is a predetermined pattern. For example, the RSS may include a set of pre-determined patterns having pre-determined meanings. The pre-determined patterns may be used to reduce the length of pressure pulse patterns, thereby making communication to the downhole tool easier.

Figure 12:
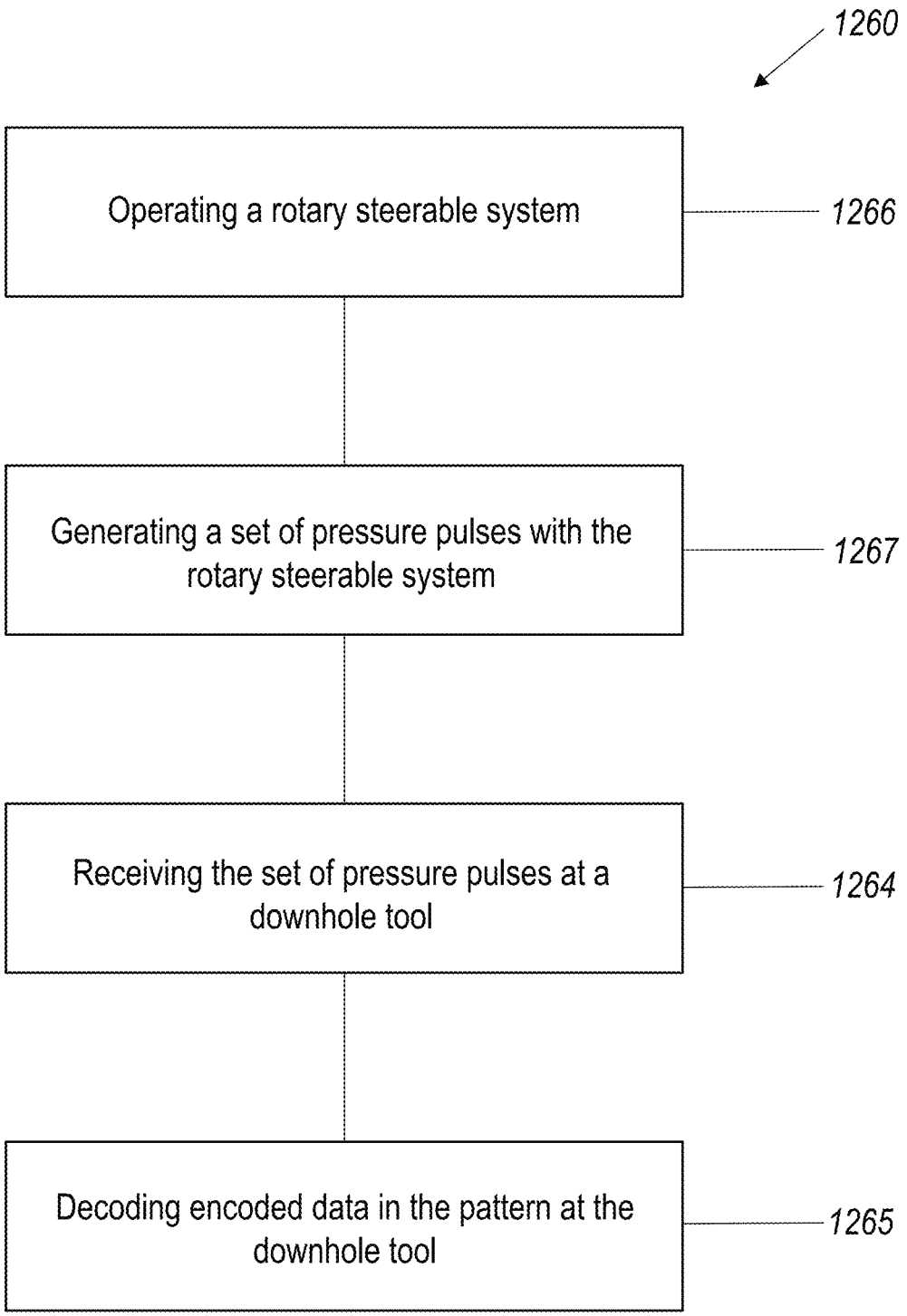
FIG. 12 is a representation of a still further method for downhole drilling, according to at least one embodiment of the present disclosure.

FIG. 12 is a representation of a method 1260 for downhole communication, according to at least one embodiment of the present disclosure. In some embodiments, the method 1260 may include operating a rotary steerable system at 1266. Operating the rotary steerable system may include flowing a fluid flow through the rotary steerable system. A digital valve of a plurality of digital valves may be opened to direct a portion of the fluid flow to an associated steering pad. The associated steering pad may be extended to contact a wellbore wall.

The method 1260 may further include generating a set of pressure pulses by selectively opening the plurality of digital valves to change a fluid pressure of the rotary steerable system at 1267. The set of pressure pulses may include encoded data. In some embodiments, the set of pressure pulses may be received at a downhole tool at 1264 and the encoded message decoded at 1265. In some embodiments, at least one drilling parameter may be changed based on the encoded data. For example, the encoded data may include instructions for a downhole tool. The downhole tool may change an operating parameter based on the encoded instructions.

This application generally relates to methods and systems for downhole pressure modulation using an RSS and a pressure pulse generator. Downhole pressure modulation may be used for many different downhole drilling activities. In some embodiments, a pressure pulse generator may be placed into a pass-through mode (e.g., turned off) to increase the pressure at the RSS. In this manner, if the dogleg of the RSS is less than a target dogleg of the RSS, then the dogleg severity may be increased by increasing the pressure at the RSS. This may increase the dogleg severity to the target dogleg. In some embodiments, simultaneously actuating the pressure pulse generator and the RSS may spike the drilling fluid pressure enough to unblock or unstick a downhole tool. Furthermore, by modulating the downhole pressure at the RSS, the RSS may generate pressure pulses to communicate with downhole tools. By modulating the pressure at the pressure pulse generator and the RSS, operation of the BHA and the downhole drilling system may be improved.

In some embodiments, a BHA includes a pressure pulse generator. The pressure pulse generator may include a flow restrictor. The flow restrictor may be longitudinally movable relative to a restriction in the bore of a housing. As the flow restrictor moves closer to the restriction, a fluid flow through the bore may be impeded. As the flow restrictor moves further away from the restriction, the fluid flow may be unimpeded. When the flow restrictor is located away from the restriction, the pressure pulse generator may be in a pass-through mode. The pass-through mode may be the mode at which the pressure pulse generator will not increase the drilling fluid pressure of the fluid flow. In other words, the fluid flow is unimpeded in the pass-through mode. Impeding and unimpeding the fluid flow may cause changes in the volumetric flow rate and/or drilling fluid pressure of the fluid flow. Placing the pressure pulse generator in pass-through mode may also be considered turning the pressure pulse generator off. By longitudinally moving the flow restrictor in a pattern, a pattern of pressure pulses (and/or flow rate pulses) may be generated.

The pattern of pressure pulses generated by the pressure pulse generator may include encoder information. In this manner, the BHA may communicate with other portions of a downhole drilling assembly, including an MWD, an LWD, other downhole tools, an RSS, the surface, and combinations thereof. In some embodiments, information may be transmitted to the pressure pulse generator from other downhole tools, such as sensors, an MWD, an LWD, the RSS, or other downhole tools. For example, information may be transmitted to the pressure pulse generator via a wired connection, a wireless connection (e.g., electromagnetic signals), or other connection. This information may be converted into a pressure pulse pattern, and the pressure pulse generator may generate pressure pulses in the pressure pulse pattern.

The BHA may include an RSS. The RSS includes a plurality of steering pads. A digital valve may be connected to the steering pad with a hydraulic pathway. The digital valve may be electronically controlled. In a first position, the digital valve may open the hydraulic pathway to the steering pad. This may cause a portion of the fluid flow to be diverted into the hydraulic pathway and to push on the steering pad. This may extend the steering pad radially outward from the RSS. The steering pad may contact a wellbore wall with a pad force. This may push on the RSS, which may push the bit in the direction opposite the pad force. By timing the actuation of the digital valves to open when the steering pad is at a specified rotational position, the bit may push on a trajectory, which may cause a dogleg in the wellbore. In some embodiments, actuating the digital valve (and the steering pad) may change the pressure of the fluid flow.

In some embodiments, a digital valve may be any valve configured to open the hydraulic pathway. For example, the digital valve may be a solenoid valve, a rotary valve, a shuttle valve, a ball valve, any other valve, and combinations thereof. In some embodiments, the digital valve may be electronically actuated. In this manner, the digital valve may actuate regardless of the rotational orientation of the RSS. Actuation of the digital valve may be controlled by a processor on the RSS, by an MWD, an LWD, by any other processor, and combinations thereof.

The fluid flow may flow with a drilling fluid pressure. The drilling fluid pressure may be related to the pad force. A higher drilling fluid pressure may result in a higher pad force, and a lower drilling fluid pressure may result in a lower pad force. In some embodiments, a downhole drilling system (including the BHA) may be designed to operate at a design drilling fluid pressure. The design drilling fluid pressure may incorporate the pressure requirements of each downhole tool, including the RSS and the pressure pulse generator. Thus, when operating at the design drilling fluid pressure, the RSS may operate with a design pad force. The design pad force may be the force determined to be sufficient to steer with a target dogleg. In some embodiments, a downhole drilling system may not operate at higher than the design drilling fluid pressure. The surface pumps, which pump the drilling fluid downhole, may be sized to operate at the design drilling fluid pressure and a design volumetric flow rate. However, in some embodiments, the surface pumps may not safely operate at higher pressure than the design drilling fluid pressure.

In some embodiments, an operating dogleg may be an actual measured dogleg of the downhole drilling system. In some embodiments, the operating dogleg may be different from the target dogleg. For example, the operating dogleg may be less than the target dogleg. In other words, the wellbore may not be turning as sharply as desired or intended. In some embodiments, increasing the pad force with which the steering pad pushes against the wellbore wall may increase the operating dogleg. However, because the surface pumps may not safely operate at a higher pressure and/or volumetric flow rate than the design fluid pressure, then the pad force at the design drilling fluid pressure may not be increased.

In some embodiments, the operating drilling fluid pressure may be increased by moving the flow restrictor toward the restriction. This increase in operating drilling fluid pressure may increase the pad force against the wellbore wall by the steering pad. The increase in pad force may increase the operating dogleg. In some embodiments, the increase in pad force may cause the operating dogleg to be closer to the target dogleg, or to reach the target dogleg. Drilling at the target dogleg may reduce the amount of drilling required to reach a target formation and/or longitudinal location, thereby reducing the total cost of the wellbore.

In some embodiments a method for downhole drilling may include directionally drilling using an RSS. In some embodiments, one or more steering pads of the RSS may push on a wellbore wall with a pad force. The pad force may be determined by a drilling fluid pressure of a fluid flow flowing through the RSS. A digital valve may open and close a hydraulic pathway to the steering pad.

The method may include determining an operating dogleg. In some embodiments, determining the operating dogleg may include measuring the operating dogleg. For example, an MWD or LWD tool may include trajectory sensors. The MWD or LWD may measure an inclination of the wellbore using the trajectory sensors. The inclination of the wellbore may be used to determine the operating dogleg. In some embodiments, the inclination may be compared to historical drilling data to determine how fast the inclination is changing per 100 feet drilled to determine the operating dogleg. In some embodiments, the inclination may be compared to a target inclination at the location the inclination was measured to determine the operating dogleg. In some embodiments, the operating dogleg may be received from another source. For example, the operating dogleg may be received from another downhole tool, from the surface, from a sensor, from any other location, and combinations thereof.

In some embodiments, the operating dogleg may be compared to a target dogleg. If the operating dogleg is different than the target dogleg, then an operating state of the pressure pulse generator may be changed. In this manner, a severity of the dogleg may be changed based on the operating state of the pressure pulse generator. In some embodiments, the operating dogleg may be different from the target dogleg because of changes in drilling conditions, such as the hardness of the formation against which the steering pad is pushing. In some embodiments, if the operating dogleg is less than the target dogleg, then the pressure pulse generator may be placed into a pass-through mode. This may reduce the pressure drop at the pressure pulse generator, which may increase the pressure available for the RSS to use for steering. Increasing the pressure available for the RSS to use for steering may increase the pad force applied by the steering pad against the wellbore wall, which may increase the severity of the dogleg. Thus, the drilling fluid pressure of the fluid flow may be increased past the design drilling fluid pressure without increasing the pressure and/or flow rate of the surface pumps. Accordingly, if the design fluid pressure is considered 100% of the drilling fluid pressure, then, by placing the mud pulse generator in pass-through mode, the drilling fluid pressure may be increased to 100+%, including 101%, 102%, 105%, 110%, and more.

In some embodiments, if the determined operating dogleg is greater than the target dogleg, and the pressure pulse generator is in the pass-through mode, the pressure pulse generator may be turned back on (e.g., begin generating pressure pulses). In this manner, the pressure pulse generator may only be turned off (e.g., placed in the pass-through mode) when the operating dogleg is less than the target dogleg.

In some embodiments, a method for downhole drilling includes applying a first pad force to a wellbore wall with a rotary steerable system. The first pad force may be applied to the wellbore wall with a steering pad of the rotary steerable system. The first pad force may be dependent upon the operating drilling fluid pressure. When the drilling fluid pressure is at a design drilling fluid pressure, the first pad force may be at a design pad force. The design pad force may be the maximum available pad force to the wellbore wall by the steering pad when the surface pumps are operating at full capacity and a pressure pulse generator is generating pressure pulses. In some embodiments, each steering pad of a plurality of steering pads on the RSS may push against the wellbore wall with the same pad force.

In some embodiments, the method may include determining an operating dogleg that is associated with the first pad force. The operating dogleg may be based on drilling conditions. For example, the hardness of the formation may have an effect on the operating dogleg. A harder formation may be harder to turn a dogleg in, and therefore a greater pad force may be required to push the bit with the target dogleg. In some embodiments, the operating dogleg may be determined from the RSS. In other words, the RSS may include one or more sensors configured to determine the operating dogleg.

In some embodiments, the method may include determining a dogleg difference between the operating dogleg and a target dogleg. In some embodiments, the dogleg difference may be determined at the location of the RSS, based on the location of the determined operating dogleg. The dogleg difference has a dogleg difference tolerance, which is the operating dogleg divided by the target dogleg multiplied by 100. In some embodiments, the dogleg difference tolerance may be in a range having an upper value, a lower value, or upper and lower values including any of 80%, 85%, 90%, 91%, 92%, 93%, 94%, 95%, 96%, 97%, 98%, 99%, or any value therebetween. For example, the dogleg difference tolerance may be greater than 80%. In another example, the dogleg difference tolerance may be less than 99%. In yet other examples, the dogleg difference tolerance may be any value in a range between 80% and 99%. In some embodiments, it may be critical that the dogleg difference tolerance is greater than 90% to change the severity of the operating dogleg to the target dogleg. In other embodiments, the dogleg difference tolerance is less than 80% or greater than 99%.

In some embodiments, based on the dogleg difference, a pressure drop at a pressure pulse generator may be changed. For example, if the dogleg difference is outside of (e.g., less than) a dogleg difference tolerance of 90%, then the pressure drop at the pressure pulse generator may be reduced, such as by placing the pressure pulse generator in the pass-through mode. In some embodiments, reducing the pressure drop at the pressure pulse generator may include pausing operation of the pressure pulse generator if the dogleg difference is outside of the dogleg difference tolerance. In some embodiments, if the dogleg difference tolerance is greater than 100%, and the pressure pulse generator is in the pass-through mode, or a reduced communication mode, then the pressure drop at the pressure pulse generator may be increased, such as by resuming or increasing pressure pulse generation at the pressure pulse generator.

In some embodiments, the method may include applying a second pad force to the wellbore wall with the rotary steerable system based on the change in pressure drop at the pressure pulse generator. The second pad force may be different than the first pad force. In some embodiments, the second pad force may be larger than the first pad force. For example, if the pressure drop at the pressure pulse generator is reduced, then the pressure available to the RSS may be increased, which may increase the first pad force to the second pad force. In some embodiments, applying the increased second pad force may increase the severity of the operating dogleg. In some embodiments, the severity of the operating dogleg may be increased to the target dogleg or above the target dogleg.

In some embodiments, the operating state (and therefore the pressure drop) at the pressure pulse generator may be changed based on measurements taken at the pressure pulse generator. In other words, the pressure pulse generator may include sensors and a processor which may measure the operating dogleg and compare it to the target dogleg to determine the dogleg difference. The processor may further determine, based on the dogleg difference, whether or not to change the operating state of the pressure pulse generator. In some embodiments, this analysis may be completed remotely from the pressure pulse generator. For example, this analysis may be completed by an MWD or an LWD. The MWD may determine the operating dogleg, compare it to the target dogleg, and send the results to the pressure pulse generator. In some embodiments, the MWD may send instructions to the pressure pulse generator to change its operating status. In some embodiments, the MWD may communicate with the pressure pulse generator by wired communication, wireless electromagnetic communication, pressure pulse, or any other downhole communication method. In some embodiments, the RSS may determine the operating dogleg, determine the dogleg difference, and send the results instructions to the pressure pulse generator to change its operating state. In some embodiments, one or both of the operating dogleg and the dogleg difference may be determined at the surface, and the surface may transmit instructions to the pressure pulse generator to change its operating state.

In some embodiments, a method for downhole drilling includes transmitting a pressure signal using a pressure pulse generator. The pressure pulse signal may be transmitted with a pressure drop at the pressure pulse generator. The method may include applying a first pad force to a wellbore wall with an RSS. The first pad force may be associated with a drilling fluid pressure at the RSS. The first pad force may be a maximum available pad force when the surface pumps are operating at capacity and the pressure pulse generator is generating pressure pulses.

The method may include determining an operating dogleg. The operating dogleg may be compared to a target dogleg to determine a dogleg difference. In some embodiments, if the dogleg difference is outside of a dogleg difference tolerance, the pressure pulse signal may be modified to change the pressure drop at the pressure pulse difference. In some embodiments, modifying the pressure pulse signal may include pausing transmission of the pressure pulse signal. This may reduce the pressure drop at the pressure pulse generator and cause a second pad force to be applied to the wellbore wall. The second pad force may be different from the first pad force. For example, if pressure pulses are paused at the pressure pulse generator, the second pad force may be greater than the first pad force.

In some embodiments, modifying the pressure pulse signal may include reducing the amount of data transmitted by the pressure pulse generator. For example, modifying the pressure pulse signal may include reducing the amount of data transmitted by the pressure pulse generator to critical data, such as azimuth, inclination, or other information determined to be critical by an operator. In some embodiments, modifying the pressure pulse signal may include storing information to be transmitted when the transmission of the pressure pulse signal is resumed. In some embodiments, modifying the pressure pulse signal may include transmitting every other survey measurement, or some other periodic transmission of survey measurements or other data.

In some embodiments, the pressure pulse signal may be paused mid-signal. When the pressure pulse generator receives an instruction to modify or pause the pressure pulse signal, the pressure pulse generator may immediately stop transmitting the pressure pulse signal. When a receiver receiving the pressure pulse signal hears a break in transmission, the receiver may wait until the pressure pulse signal resumes. When the pressure pulse signal resumes, the pressure pulse generator may pick up where it left off, and the receiver may remove the gap from the pressure pulse signal to decode the signal.

In some embodiments, the pressure pulse generator may transmit a "stop code" before pausing transmission of the pressure pulse signal. The stop code may indicate to any receiver receiving the pressure pulse signal that the pressure pulse signal is about to be paused. When the pressure pulse generator begins transmitting the pressure pulse signal again, the pressure pulse generator may transmit a "start code" before picking up the transmission where it left off. In some embodiments, the pressure pulse generator may finish a pressure pulse signal before pausing transmission. In some embodiments, the pressure pulse generator may repeat some or all of the interrupted signal after resuming transmission.

In some embodiments, the pressure pulse generator may resume the pressure pulse signal when the dogleg difference is within the dogleg difference tolerance. In this manner, the pressure pulse generator may give pressure priority to the RSS. In other words, the RSS may have priority to downhole drilling pressure over the pressure pulse generator. This may help the operating dogleg to remain close to the target dogleg, which may keep the wellbore on the target trajectory, thereby saving time and money.

In some embodiments, a BHA may have a pressure pulse generator. The pressure pulse generator may include a flow restrictor. The flow restrictor may be longitudinally movable relative to a restriction in the bore of a housing. As the flow restrictor moves closer to the restriction, a fluid flow through the bore may be impeded, increasing the drilling fluid pressure. By moving the flow restrictor back and forth relative to the restriction, changes in the flow rate and/or hydraulic pressure of the fluid flow may be made.

The BHA includes an RSS. The RSS includes a plurality of steering pads. A digital valve may be connected to the steering pad with a hydraulic pathway. The digital valve may be electronically controlled. In a first position, the digital valve may open the hydraulic pathway to the steering pad. This may cause a portion of the fluid flow to be diverted into the hydraulic pathway and to push on the steering pad. This may extend the steering pad radially outward from the RSS. The steering pad may contact a wellbore wall with a pad force. This may push on the RSS, which may push the bit in the direction opposite the pad force. By timing the actuation of the digital valves to open when the steering pad is at a specified rotational position, the bit may push on a trajectory, which may cause a dogleg in the wellbore. In some embodiments, actuating the digital valve (and the steering pad) may change the pressure of the fluid flow.

The BHA further includes a downhole tool. The downhole tool may be mud-actuated (e.g., drilling-fluid actuated) downhole tool. For example, the downhole tool is a mud-actuated reamer. However, it should be understood that the downhole tool may include any mud-actuated downhole tools, including section mills, casing cutters, turbines, motors, other downhole tools, and combinations thereof. In some embodiments, the downhole tool may be a moving component of a downhole tool, such as a piston, valve, shuttle, sleeve, pathway, other moving component, and combinations thereof.

In some embodiments, the downhole tool may move between a first position and a second position. The downhole tool follows an actuation path. In some embodiments, the actuation path may include the path that a moving component of the downhole tool follows. For example, a reamer block moves uphole, the reamer block may extend pass the housing. As the reamer block moves downhole, the reamer block may retract into the housing.

In some embodiments, debris may become caught in the actuation path. This may prevent the reamer block from moving along the actuation path. Indeed, in some embodiments, the reamer block may become stuck in the actuation path. Accordingly, the reamer block may not fully extend or retract at the appropriate time. This may cause damage to the wellbore and/or to the downhole tool (including the reamer block).

In some embodiments, an increase in drilling fluid pressure of the fluid flow may clear the actuation path and/or unstick the reamer block. In some embodiments, the drilling fluid pressure may be increased by increasing the output of the surface pumps. In some embodiments, the drilling fluid pressure may be increased by actuating the pressure pulse generator and/or the RSS. This may temporarily spike or increase the drilling fluid pressure. In some embodiments, the increase in drilling fluid pressure may dislodge the debris and/or unstick the downhole tool.

In some embodiments, actuating the RSS may include actuating a single steering pad (by actuating the associated digital valve) of the plurality of steering pads on the RSS. In some embodiments, actuating the RSS may include actuating more than one steering pad (and the associated digital valve) of the plurality of steering pads on the RSS at the same time. In some embodiments, actuating the RSS may include actuating each steering pad (and each associated digital valve) of the plurality of steering pads at the same time. The more steering pads actuated, the higher the spike in drilling fluid pressure.

In some embodiments, actuating the pressure pulse generator may include moving the flow restrictor longitudinally toward the restriction. In some embodiments, the pressure pulse generator and the RSS may be actuated simultaneously. Simultaneous actuation of the pressure pulse generator and the RSS may include actuating them at the same time. In some embodiments, the change in pressure of the fluid flow may take a period of time to travel to the downhole tool, and simultaneous actuation of the pressure pulse generator may include timing the actuation of the pressure pulse generator and the RSS so that the resulting increase in pressure will reach the downhole tool at the same time.

In some embodiments, the operating position of the downhole tool may be determined using a sensor. The sensor may be any type of sensor capable of determining the operating position of the downhole tool. For example, the sensor may be a position sensor. The position sensor may sense the position of the reamer block, and a determination may be made if the reamer block is in position. In some examples, the sensor may be a pressure sensor. The downhole tool may include an operating pressure, and the sensor may determine if the measured pressure is the operating pressure. In some embodiments, the sensor may include both a position sensor and a pressure sensor. In this manner, both the measured position and the measured pressure may be used to determine whether the downhole tool is clogged and/or stuck.

In some embodiments, a method for drilling may include flowing a fluid flow through a BHA. The BHA may include a pressure pulse generator, a rotary steerable system, and a mud-actuated downhole tool. The fluid flow has a drilling fluid pressure. In some embodiments, the drilling fluid pressure may be a design drilling fluid pressure (e.g., the drilling fluid pressure downhole when the surface pumps are operating at full capacity and the pressure pulse generator is generating pressure pulses).

The method may include determining an operating state of a downhole tool. In some embodiments, determining the operating state of the downhole tool may include determining that the downhole tool is clogged. In other words, determining the operating state of the downhole tool may include determining that debris block at least a portion of an actuating path or a hydraulic pathway of the downhole tool. This may cause the downhole tool to become stuck and/or for the downhole tool to not fully actuate.

Based on the operating state, the fluid pressure of the fluid flow may be increased. The fluid pressure of the fluid flow may be increased by simultaneously actuating the pressure pulse generator and one or more steering pads from the RSS. In some embodiments, actuating the pressure pulse generator may include moving the pressure pulse generator into a high-pressure state (e.g., with the flow restrictor moved close to the restriction). In some embodiments, one, more than one, or all of the steering pads of the RSS may be actuated. By simultaneously actuating the pressure pulse generator and one or more steering pads of the RSS, the drilling fluid pressure may be increased over the design drilling fluid pressure. In some embodiments, this may unclog the downhole tool. For example, increasing the drilling fluid pressure may remove any debris that have collected in the actuation path and/or a hydraulic pathway. In some examples, increasing the drilling fluid pressure may unstick a moving part of the downhole tool. In some examples, increasing the drilling fluid pressure may cause the moving part of the downhole tool to push any debris in the actuation path out of the way. Unclogging (or unsticking) the downhole tool may help to prevent damage to the downhole tool and/or the wellbore. In some embodiments, unclogging or unsticking a downhole tool may prevent tripping the downhole tool out of the wellbore for servicing, thereby saving time and money.

In some embodiments, a method for downhole drilling includes operating a downhole tool at a first drilling fluid pressure (e.g., an operating drilling fluid pressure). Operating the downhole tool may include actuating a downhole too, opening or closing a valve, extending or retracting a piston, moving a movable component of the downhole tool, and combinations thereof. In some embodiments, the method may include determining an operating position of the downhole tool. The downhole tool may include more than one tool position. Operating the downhole tool may include changing the downhole tool between a first tool position and a second tool position. The downhole tool has a target tool position based on the operating drilling fluid pressure. Accordingly, the downhole tool should be in the target position when operating at the operating drilling fluid pressure.

In some embodiments, determining the operating position of the downhole tool may include sensing the operating position of the downhole tool. For example, the operating position of the downhole tool may be sensed using a position sensor. In some examples, the operating position of the downhole tool may be inferred using a pressure sensor. For example, in the target position, a mud-actuated downhole tool may have a target fluid pressure, and the operating position may be determined by the measured fluid pressure compared to the target fluid pressure. In some embodiments, both the position sensor and the pressure sensor may be used to determine the operating position of the downhole tool. For example, if the actuation path of the downhole tool is blocked and/or clogged by debris, then the measured pressure may be higher than if the actuation path is not blocked. Combined with the position measured from the position sensor, the existence and the extent of a clog or blockage may be determined based on the determined position of the downhole tool.

The method may include determining a position difference between the operating position and the target position of the downhole tool. The position difference has a position difference tolerance, which is the operating position divided by the target position multiplied by 100. In some embodiments, the position difference tolerance may be in a range having an upper value, a lower value, or upper and lower values including any of 80%, 85%, 90%, 91%, 92%, 93%, 94%, 95%, 96%, 97%, 98%, 99%, or any value therebetween. For example, the position difference tolerance may be greater than 80%. In another example, the position difference tolerance may be less than 99%. In yet other examples, the position difference tolerance may be any value in a range between 80% and 99%. In some embodiments, it may be critical that the position difference tolerance is greater than 90% to trigger unblocking of the downhole tool.

In some embodiments, the operating position may be compared to past operating position determinations. If the operating position has not changed based on changed drilling fluid pressure, then the downhole tool may be stuck. In some embodiments, the downhole tool may be stuck in the open position, the closed position, or in a position between the open position and the closed position.

In some embodiments, if the position difference is outside of the position difference tolerance, then the pressure pulse generator and at least one steering pad of the plurality of steering pads may be simultaneously actuated. Simultaneously actuating the pressure pulse generator and the at least one steering pad may increase the first drilling fluid pressure (e.g., the operating drilling fluid pressure) to a second drilling fluid pressure (e.g., an unclogging drilling fluid pressure). In some embodiments, simultaneously actuating the pressure pulse generator and the at least one steering pad includes actuating both the pressure pulse generator and the at least one steering pad at the same time. For example, an electronic connection (e.g., wired and/or electromagnetic) between the pressure pulse generator and the RSS may allow the pressure pulse generator and the RSS to coordinate the spike in drilling fluid pressure. In some embodiments, the RSS and the pressure pulse generator may coordinate the timing of the spike in drilling fluid pressure by pressure pulse. For example, if the position difference is outside of the position difference tolerance, then pressure pulse generator may send a signal to the RSS (or vice versa). The signal may include instructions for the time and/or duration of the pressure spike.

In some embodiments, simultaneously actuating the pressure pulse generator and the at least one steering pad may include actuating more than one steering pad of the plurality of steering pads. In some embodiments, each steering pad of the plurality of steering pads may be actuated. In some embodiments, simultaneously actuating the pressure pulse generator may remove debris from the actuating path and/or hydraulic pathway of the downhole tool. For example, the pressure spike may dislodge the debris, thereby unclogging the actuating path and/or the hydraulic pathway. In some embodiments, the pressure spike may force the moving component of the downhole tool to move, unsticking a stuck downhole component (and dislodging any debris in the actuation pathway).

In some embodiments, simultaneously actuating the pressure pulse generator and the at least one steering pad may include simultaneously actuating the pressure pulse generator and the at least one steering pad for an unclogging period. In some embodiments, the unclogging period may be until the operating position of the downhole tool is within the position difference tolerance. In some embodiments, the unclogging period may be fixed. In some embodiments, the unclogging period may be in a range having an upper value, a lower value, or upper and lower values including any of 0.1 s, 0.5 s, 1 s, 5 s, 10 s, 15 s, 20 s, 30 s, 45 s, 60 s, 120 s, 600 s, or any value therebetween. For example, the unclogging period may be greater than 0.1 s. In another example, the unclogging period may be less than 600 s. In yet other examples, the unclogging period may be any value in a range between 0.1 s and 600 s. In some embodiments, it may be critical that the unclogging period is greater than 5 s to sufficiently unclog the actuation pathway.

In some embodiments, when the position difference is back within the position difference tolerance, at least one of the pressure pulse generator or the at least one steering pad may be deactivated. In other words, when the downhole tool moves to the target position, the pressure pulse generator may resume transmitting pressure pulses and the one or more steering pads on the RSS may resume actuating to steer the bit. In this manner, downhole drilling activities may resume with the downhole tool in operating condition (e.g., unstuck).

In some embodiments, the actuating pathway may clog with debris each time the downhole tool is shut down. Accordingly, the downhole tool may need to be unclogged at startup each time the downhole drilling system is started, and/or each time the downhole tool is actuated. In some embodiments, the actuating path of the downhole tool may be regularly flushed out. For example, the pressure pulse generator and the RSS may periodically simultaneously actuate to clear the actuating path of any accumulated debris. This may help to prevent the downhole tool from sticking, thereby saving time and money.

In some embodiments, a method for drilling may include flowing a fluid flow through a BHA. The BHA may include a pressure pulse generator, an RSS, and a mud-actuated downhole tool. The fluid flow has a drilling fluid pressure. In some embodiments, the drilling fluid pressure may be a design drilling fluid pressure (e.g., the drilling fluid pressure downhole when the surface pumps are operating at full capacity and the pressure pulse generator is generating pressure pulses).

In some embodiments, an increase in drilling fluid pressure may actuate the downhole tool. To increase the drilling fluid pressure, the pressure pulse generator and the RSS may be simultaneously actuated. This may increase the drilling fluid pressure from the operating fluid pressure to an actuating fluid pressure. In some embodiments, simultaneously actuating the pressure pulse generator and the RSS may include actuating at least one steering pad of a plurality of steering pads on the RSS. In some embodiments, each steering pad of the plurality of steering pads may be actuated. Actuating more steering pads may increase the actuating fluid pressure.

In some embodiments, increasing the drilling fluid pressure to the actuating fluid pressure may actuate a drilling fluid-actuated (e.g., mud-actuated) tool. In some embodiments, actuating the mud-actuated tool may include extending an extendable component of the downhole tool, opening a valve, closing a valve, extending a piston, retracting a piston, move another downhole component, and combinations thereof. Simultaneously actuating the pressure pulse generator and the RSS to spike the design drilling fluid pressure to the actuating pressure may reduce the design drilling fluid pressure of the system. This may reduce the size of the surface pumps by requiring a lower flow rate to reach the actuating fluid pressure, which may reduce the overall cost of the downhole drilling system. In some embodiments, this may allow the actuating fluid pressure of the mud-actuated tool to be increased. This may help to prevent accidental actuation of the mud-actuated tool, which may help to prevent damage to the mud-actuated tool and/or the wellbore.

In some embodiments, a method for downhole communication may include flowing a fluid flow through an RSS. The fluid flow may be the same fluid flow that flows through a BHA. Thus, changes in volumetric flow rate, fluid pressure, and other drilling fluid properties may be sensed at both the RSS and at other tools on the BHA, and even at the surface.

In some embodiments, the method may include opening at least one digital valve of a plurality of digital valves to actuate an associated steering pad at the RSS. In some embodiments, the digital valve may be opened in a pattern, the pattern including encoded data. The method may include changing the fluid flow in response to opening the at least one digital valve. In some embodiments, the changes in the fluid flow may include changes in drilling fluid pressure, changes in volumetric flow rate, or other changes. In this manner, the steering pads of the RSS may act as a pressure pulse generator. In other words, the RSS may generate a pressure pulse signal by selectively actuating the steering pads.

In some embodiments, the pattern may be received at a downhole tool based on changes in the flow rate. In some embodiments, the downhole tool may be an MWD, an LWD, a pressure pulse generator, or any other downhole tool. In some embodiments, the pattern may be received based on changes in the volumetric flow rate. In some embodiments, the pattern may be received based on changes in the drilling fluid pressure. In some embodiments, the pattern may be demodulated (e.g., decoded) at the downhole tool. In this manner, the RSS may transmit the encoded data to the downhole tool. This may allow the RSS to communicate with the downhole tool. In some embodiments, pressure pulses from the RSS steering pads may be the primary form of communication from the RSS to the downhole tool. In some embodiments, pressure pulses from the RSS steering pads may be backup communication from the RSS to the downhole tool. For example, RSS may communicate via electromagnetic signal to the downhole tool. However, if the electromagnetic transmitter fails, then the RSS may transmit information, such as a downhole tool status, to the downhole tool.

In some embodiments, a single digital valve may be actuated in the pattern to generate the pressure pulses. In this manner, if the RSS includes three digital valves and associated steering pads, then one digital valve may generate the pressure pulses and the remaining digital valves may be used for downhole steering. In some embodiments, to increase the change in pressure, a plurality of digital valves may be opened simultaneously. In some embodiments, each digital valve of the plurality of digital valves may be opened to maximize the change in pressure in the pressure pulses.

In some embodiments, the digital valves of the plurality of digital valves may be opened independently. For example, if a single digital valve is being used to communicate, then the RSS may determine, at a specific point in the pattern, which digital valve may be used for steering, and which digital valve may be used for communication. In this manner, the RSS may determine how to communicate with the downhole tool without impacting steering activities. In some embodiments, the RSS may generate pressure pulses when the RSS is steering in a neutral direction (e.g., without dogleg, or without changing the azimuth or inclination). Thus, the digital valve used to form the pressure pulse may be selected based on a pad force by the steering pad to keep the RSS steering in the neutral mode. In some embodiments, the digital valve to be opened may be selected based on a trajectory deviation of the RSS from the neutral direction. In some embodiments, each digital valve in the RSS may be opened in sequence (e.g., by always opening the immediately clockwise or counter-clockwise adjacent digital valve). This may help to steer the RSS, such as in the neutral direction.

In some embodiments, a method for downhole communication may include flowing a fluid flow through an RSS. The RSS may include a plurality of digital valves that actuate a plurality of steering pads. In some embodiments, the method may include changing a fluid pressure of the fluid flow. Changing the fluid pressure of the fluid flow may include actuating at least one digital valve of the plurality of digital valves in a pattern, the pattern including encoded data. Changing the fluid pressure of the fluid flow may further include extending and retracting a steering pad of the plurality of steering pads associated with the digital valves. In some embodiments, the changes in fluid pressure may be between 10 psi and 100 psi.

The method may include receiving the change in fluid pressure at a downhole tool. In some embodiments, the pressure pulses may be received at a surface location. The encoded data in the pattern may be decoded at the downhole tool. In some embodiments, the encoded data may include an instruction for the downhole tool. In some embodiments, the instructions may include instructions to change one or more drilling parameters. For example, the encoded data may include an instruction for a downhole tool to be actuated, for the downhole tool to take a measurement (e.g., azimuth and/or inclination measurement, gamma ray measurement), or other instruction.

In some embodiments, the encoded data may include azimuth and inclination data. For example, the RSS may include one or more sensors. The one or more sensors may measure the azimuth and/or the inclination. The RSS may transmit the azimuth and inclination data to the downhole tool. In some embodiments, the downhole tool may be an MWD, which may include azimuth and inclination sensors. The MWD may compare the received azimuth and inclination data and determine how the trajectory of the wellbore is changing. In some embodiments, the pattern is a predetermined pattern. For example, the RSS may include a set of pre-determined patterns having pre-determined meanings. The pre-determined patterns may be used to reduce the length of pressure pulse patterns, thereby making communication to the downhole tool easier.

In some embodiments, a method for downhole communication may include operating a rotary steerable system. Operating the rotary steerable system may include flowing a fluid flow through the rotary steerable system. A digital valve of a plurality of digital valves may be opened to direct a portion of the fluid flow to an associated steering pad. The associated steering pad may be extended to contact a wellbore wall.

The method may further include generating a set of pressure pulses by selectively opening the plurality of digital valves to change a fluid pressure of the rotary steerable system. The set of pressure pulses may include encoded data. In some embodiments, the set of pressure pulses may be received at a downhole tool and the encoded message decoded. In some embodiments, at least one drilling parameter may be changed based on the encoded data. For example, the encoded data may include instructions for a downhole tool. The downhole tool may change an operating parameter based on the encoded instructions.

The embodiments of the methods for BHA pressure control have been primarily described with reference to wellbore drilling operations; the methods for BHA pressure control described herein may be used in applications other than the drilling of a wellbore. In other embodiments, methods for BHA pressure control according to the present disclosure may be used outside a wellbore or other downhole environment used for the exploration or production of natural resources. For instance, methods for BHA pressure control of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for downhole communication, comprising:

flowing a fluid flow through a rotary steerable system;

determining a first steering pad of a plurality of steering pads to engage a wellbore wall to perform downhole steering;

actuating the first steering pad of the plurality of steering pads to engage a wellbore wall and perform the downhole steering;

determining a second steering pad of the plurality of steering pads to generate pressure pulses during the downhole steering;

while performing the downhole steering, actuating the second steering pad in a pattern without impacting the downhole steering, the pattern including encoded data;

changing at least one of the fluid flow or a drilling fluid pressure in response to actuating the second steering pad of the plurality of steering pads; and receiving the pattern at a downhole tool based on the changes in the at least one of the fluid flow or the drilling fluid pressure.

2. The method of claim 1, further comprising demodulating the pattern at the downhole tool.

3. The method of claim 1, wherein receiving the pattern includes detecting a change in a flow rate of the fluid flow based on the change in the fluid flow.

4. The method of claim 1, wherein receiving the pattern includes detecting a change in a fluid pressure of the fluid flow based on the change in the fluid flow.

5. The method of claim 1, wherein actuating the second steering pad includes simultaneously actuating the second steering pad of the plurality of steering pads and a third steering pad of the plurality of steering pads.

6. The method of claim 1, wherein actuating the second steering pad of the plurality of steering pads in the pattern includes actuating the second steering pad of the plurality of steering pads independently of the first steering pad of the plurality of steering pads.

7. The method of claim 6, wherein the second steering pad of the plurality of steering pads is actuated in sequence with a third steering pad of the plurality of steering pads with the pattern.

8. The method of claim 1, wherein actuating the first steering pad includes steering the rotary steerable system without changing an azimuth or an inclination of the rotary steerable system.

9. The method of claim 8, wherein steering the rotary steerable system without changing the azimuth or the inclination includes selecting the first steering pad to actuate based on a trajectory deviation of the rotary steerable system.

10. A method for downhole communication, comprising:

flowing a fluid flow through a rotary steerable system, the rotary steerable system including a plurality of digital valves that actuate a plurality of steering pads;

steering by actuating first digital valve of the plurality of digital valves to extend and retract a first steering pad of the plurality of steering pads to engage a wellbore wall;

changing a fluid pressure of the fluid flow by:

while steering and without impacting steering activities, actuating at least one-a second digital valve of the plurality of digital valves in a pattern, the pattern including encoded data; and extending and retracting a second steering pad of the plurality of steering pads associated with the second digital valve of the plurality of digital valves;

receiving the change in the fluid pressure at a downhole tool; and decoding the encoded data in the pattern at the downhole tool.

11. The method of claim 10, wherein the encoded data includes an instruction for the downhole tool.

12. The method of claim 10, wherein the pattern is a pre-determined pattern encoding pre-determined meaning.

13. The method of claim 10, wherein the encoded data includes azimuth and inclination data.

14. The method of claim 10, wherein the encoded data includes a status of the rotary steerable system.

15. The method of claim 10, further comprising receiving the change in the fluid pressure at a surface location.

16. The method of claim 10, wherein changing the fluid pressure includes changing the fluid pressure by between 5 psi and 300 psi.

17. A method for downhole communication, comprising:

operating a rotary steerable system, including:

flowing a fluid flow through the rotary steerable system;

opening a first digital valve of a plurality of digital valves to direct a portion of the fluid flow to an associated steering pad of a plurality of steering pads;

extending the associated steering pad of the plurality of steering pads to contact a wellbore wall to perform downhole steering;

independent of the first digital valve and without impacting steering activities, opening a second digital valve of the plurality of digital valves to change a fluid pressure of the rotary steerable system and generate a set of pressure pulses, the set of pressure pulses including encoded data;

receiving the set of pressure pulses at a downhole tool; and decoding the encoded data at the downhole tool.

18. The method of claim 17, further comprising changing at least one drilling parameter based on the encoded data.

19. The method of claim 17, wherein generating the set of pressure pulses includes simultaneously opening each digital valve of the plurality of digital valves.

20. The method of claim 17, wherein receiving the set of pressure pulses includes receiving the set of pressure pulses at an MWD.

* * * * *